US006993273B2

(12) United States Patent
Yamada

(10) Patent No.: US 6,993,273 B2
(45) Date of Patent: Jan. 31, 2006

(54) DEVELOPER SUPPLY CONTAINER, AND COUPLING-DRIVING MEMBER FOR DEVELOPER SUPPLY CONTAINER

(75) Inventor: Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 58 days.

(21) Appl. No.: 10/761,316

(22) Filed: Jan. 22, 2004

(65) Prior Publication Data

US 2004/0190945 A1 Sep. 30, 2004

(30) Foreign Application Priority Data

Jan. 22, 2003 (JP) ..... 2003-014010

(51) Int. Cl.
*G03G 15/00* (2006.01)
*G03G 15/08* (2006.01)

(52) U.S. Cl. ..... 399/258; 399/167; 399/262; 222/DIG. 1

(58) Field of Classification Search ..... 222/DIG. 1, 222/167, 169; 399/103, 105, 106, 167, 262, 399/263
See application file for complete search history.

(56) References Cited

U.S. PATENT DOCUMENTS 5,828,935 A 10/1998 Tatsumi et al. ..... 399/260
6,032,013 A * 2/2000 Niizawa ..... 399/262
2002/0031638 A1 3/2002 Yamada et al. ..... 428/99
2002/0106215 A1 8/2002 Ban et al. ..... 399/120
2002/0127029 A1 9/2002 Yamada et al. ..... 399/106
2004/0009006 A1 1/2004 Yamada et al. ..... 399/106

FOREIGN PATENT DOCUMENTS

JP 2002-318490 10/2002

OTHER PUBLICATIONS

Patent Abstracts of Japan, Publication No. 2002-318490, Oct. 31, 2002.

* cited by examiner

*Primary Examiner*—Hoang Ngo
(74) *Attorney, Agent, or Firm*—Fitzpatrick, Cella, Harper & Scinto

(57) ABSTRACT

A developer supply container detachably mountable to an image forming apparatus, the container includes a container body for accommodating the developer; drive connection member, provided substantially at a rotation center of the developer supply container, for driving engagement with a driving member provided in the image forming apparatus, wherein the drive connection member has a drive transmitting portion for transmitting a rotational force received from the driving member to the container body, wherein the drive transmitting portion is disposed so as to be idly rotatable for a sufficient time after start of rotation of the drive transmitting portion and before engagement with the container body.

21 Claims, 18 Drawing Sheets

(a)

(b)

DEVELOPER SUPPLY CONTAINER, AND COUPLING-DRIVING MEMBER FOR DEVELOPER SUPPLY CONTAINER

FIELD OF THE INVENTION AND RELATED ART

The present invention relates to a developer supply container removably mountable in an image forming apparatus in order to supply the image forming apparatus with developer. Here, an image forming apparatus means an apparatus, such as a copying machine, a printer, a fax, etc., for forming images with the use of an electrophotographic or electrostatic recording method. The present invention also relates to a member with which a developer supply container is provided in order to coupling the developer supply container with the main assembly of the image forming apparatus, and also, to driving the container.

Developer (toner) in the form of an extremely minute particle has been in use as developer for an electrophotographic image forming apparatus such as an electrophotographic copying machine or printer. It has been common practice that as the toner in the main assembly of an electrophotographic image forming apparatus is consumed, the main assembly is supplied with toner, with the use of a developer supply container (toner container). Incidentally, an electrophotographic image forming apparatus means an apparatus for forming images on recording medium with the use of an electrophotographic image forming method. An electrophotographic image forming apparatus includes an electrophotographic copying machine, an electrophotographic printers (for example, laser beam printer, LED printer, etc.), a facsimile apparatus, a wordprocessor, etc.

Toner is in the form of an extremely minute particle, tending to scatter when the main assembly of an image forming apparatus is supplied with toner. Thus, there has been known a toner supplying method in which toner is discharged into the main assembly of an image forming apparatus little by little from the small opening of a developer supply container placed in the main assembly, in order to prevent the toner from scattering. All of the developer supply containers of the above described type are structured so that their developer conveying members, or containers proper, of the developer supply containers are driven through some kind of means from the main assembly side of an image forming apparatus, in order to discharge the toner.

There are several means for transmitting driving force from the main assembly side of an image forming apparatus to the developer supply container in the main assembly. According to one of the known driving force transmitting means (for example, Japanese Laid-open Patent Application 2002-318490), a sealing member is utilized as the means for transmitting rotational driving force from the main assembly of an image forming apparatus to the container proper of a developer supply container, in order to rotate the container proper so that the toner in the container is conveyed therein and discharged therefrom.

In the case of the above described structural arrangement for a developer supply container, as the front cover of the main assembly of an image forming apparatus is closed after a developer supply container is inserted into the main assembly of the image forming apparatus, and set therein, not only is the sealing member of the developer supply container rotationally coupled with the driving portion of the main assembly by the closing movement of the front cover, but also, the container proper of the developer supply container is slidingly moved in the lengthwise direction (direction of rotational axis of container), by the closing movement of the front cover, causing thereby the sealing member to be moved, in relative terms, outward of the container proper, unsealing thereby the container proper, in other words, making therefore the developer supply container ready for toner discharge. In this case, the sealing member is provided with a non-circular (square) hole, and the square shaft of the developer conveying member disposed in the container proper of the developer supply container is structured so that it can be removably inserted, and that it is rotatable by the rotation of the sealing member. Further, the developer supply container and apparatus main assembly are structured so that the square shaft will be inserted by a predetermined length into the square hole of the sealing member in order to prevent the former from completely coming out of the latter. Therefore, the rotational driving force received by the sealing member can be transmitted to the developer conveying member.

In the case of the structural arrangement disclosed in the aforementioned patent publication, not only does the engagement of the sealing member with the driving portion of the image forming apparatus main assembly enable the sealing member to unseal the container proper of the developer supply container, but also, it enables the sealing member to receive rotational driving force from the apparatus main assembly and transmit it to the container proper. In other words, a single component, that is, the sealing member is given both the function of unsealing and resealing the container proper of the developer supply container, and the function of transmitting the force for rotating the container proper. This makes the structural arrangement superior in that it makes it possible to reduce in size and cost the main assembly of an image forming apparatus.

These methods described above, however, still suffer from several technical problems.

That is, in the case of the developer supply container in accordance with the prior art (which hereinafter may be referred to as "conventional developer supply container"), rotational driving force is transmitted by engaging the square shaft of the developer conveying member of the developer supply container into the square hole of the sealing member. Therefore, in the case of a toner bottle with a large capacity, there is the possibility that as the bottle is rotated, the square shaft will be twisted, because the container with a large capacity is substantially heavier when it is full, and the square shaft in accordance with the prior art is not strong enough to withstand the force applied to rotate the bottle. Besides, once the square shaft becomes twisted, it is very difficult, or impossible (although very rarely) to smoothly move the sealing member to completely seal the bottle, because the friction between the twisted square shaft and the sealing member is greater than the friction between the straight square shaft.

Referring to FIGS. 17 and 18, this phenomenon will be concretely described.

FIG. 17 is a sectional-perspective view of the sealing member portion of the developer supply container (toner bottle) in accordance with the prior art (the aforementioned laid-open patent application). FIG. 18(*a*) is a front view of the toner bottle in accordance with the prior art (the aforementioned laid-open patent application) and FIG. 18(*b*) is a sectional view of the toner bottle shown in FIG. 18(*a*), at line A—A in FIG. 18(*a*), showing the interior of the bottle from which toner is being discharged.

FIG. 18(*b*) shows the toner bottle 1A which has just stopped rotating. Normally, the body of the toner in the toner bottle 1A is continuously pushed upward, being therefore lifted slightly, by the friction between the body of toner and the internal wall of the toner bottle 1A being rotated in the direction R. Thus, while the toner bottle 1A is rotated, the body of the toner in the toner bottle 1A remains shifted downward of the vertical plane inclusive of the axial line of the toner bottle 1A, in terms of the rotational direction of the toner bottle 1A, as shown in FIG. 18(*b*). Thus, as soon as the toner bottle 1A stops rotating (as soon as the transmission of driving force from the apparatus main assembly stops), the toner bottle 1A is subjected to the force which acts to restore the gravitational equilibrium of the toner bottle 1A; in other words, the toner bottle 1A comes under the force which acts to rotate the toner bottle 1A in the direction indicated by an arrow mark Q, that is, the direction opposite to the direction in which the toner bottle 1A has been driven by the driving force from the apparatus main assembly. Further, when the toner bottle 1A is in the state shown in FIG. 18(*b*), the sealing member is still in engagement with the unshown driving portion of the main assembly, being therefore prevented from rotating in the arrow Q direction. As a result, a substantial amount of contact pressure is maintained between the wall of the square hole 2*d* of the sealing member 2 and the surface(s) of the square shaft 1*f* of the toner bottle 1A, by the rotational moment generated by the force acting in the direction to restore the gravitational equilibrium of the toner bottle 1A. The presence of this condition is more conspicuous when an attempt is made to remove a toner bottle before it becomes empty, in particular, when the amount of the toner in the toner bottle is greater, for example, shortly after the mounting of a brand-new toner bottle.

When the toner bottle 1A is in the above described state, the wall(s) of the square hole 2*d* is in contact with the surface(s) of the square shaft 1*f*. Thus, if an attempt is made to pull the bottle out of the main assembly when the bottle is in the above described state, the friction between the wall(s) of the square hole 2*d* and the surface(s) of the square shaft is much higher than when the toner bottle 1A is in the gravitational equilibrium, making it very difficult, although very rarely, to close the sealing member. This phenomenon is more likely to occur to a toner bottle with a larger diameter or a larger toner capacity than it is with a smaller diameter or a smaller toner capacity, because the greater the amount of the toner in a toner bottle, the greater the rotational moment resulting from the weight of the toner therein.

SUMMARY OF THE INVENTION

The primary object of the present invention is to provide a developer supply container capable of properly transmitting rotational driving force from the main assembly of an image forming apparatus to the container proper of the developer supply container, even if there are errors in the measurements and assemblages of the components of the developer supply container and image forming apparatus.

Another object of the present invention is to provide a coupling-driving member capable of properly transmitting rotational driving force from the main assembly of an image forming apparatus to the container proper of a developer supply container, even if there are errors in the measurements and assemblages of the components of the developer supply container and image forming apparatus.

Another object of the present invention is to provide a developer supply container having a coupling-driving member which has a sealing portion for sealing the developer outlet of the developer supply container, and which is capable of preventing the developer outlet from being improperly resealed.

Another object of the present invention is to provide a coupling-driving member which has a sealing portion for sealing the developer outlet of a developer supply container, and which is capable of preventing the developer outlet from being improperly resealed.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of a developer supply container, sealing member, and image forming apparatus, in accordance with the present invention will be described in detail with reference to the appended drawings.

(Embodiment 1)

[Electrophotographic Image Forming Apparatus]

Figure 1:
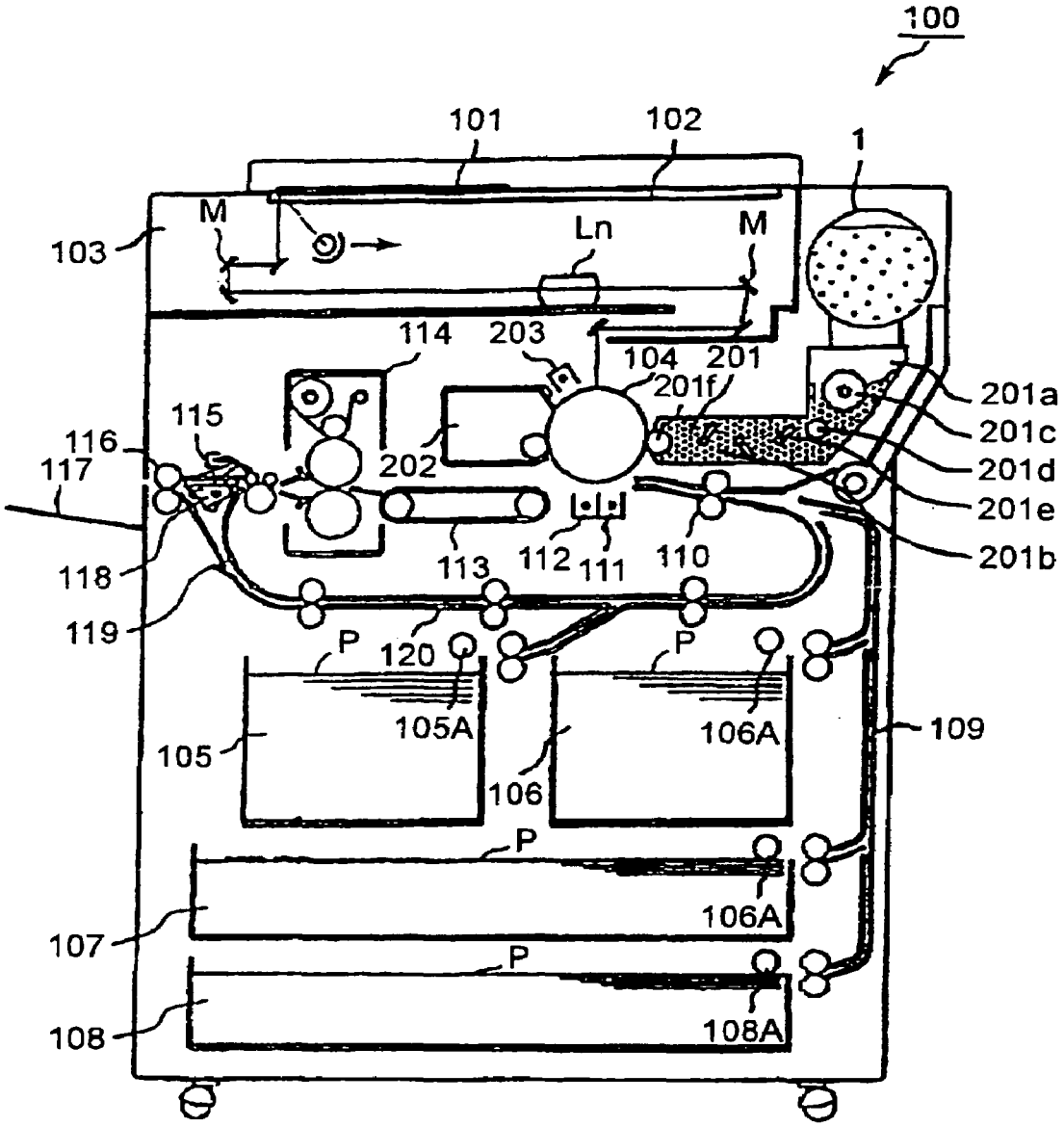
FIG. 1 is a schematic sectional view of a typical image forming apparatus, showing the general structure thereof.

First, referring to FIG. 1, the structure of an electrophotographic image forming apparatus, as an example of an image forming apparatus in which a developer supply container in accordance with the present invention, will be described. As an original 101 is placed on the original placement glass platen 102 of the main assembly 100 of the electro-photographic copying machine (which hereinafter will be referred to as "apparatus main assembly") shown in FIG. 1, the optical image (image formation data) of the original 101 is formed on the electrophotographic photosensitive drum, as an image bearing member, by the plurality of mirrors M and lenses Ln. Meanwhile, the cassette which contains the correct recording medium (which hereinafter may be simply referred as "sheets") is selected from among sheet cassettes 105–108 in the main assembly, based on the sheet size information, that its, the information inputted by a user through the control panel 100*a* (FIG. 2), or the size of the original 101. Incidentally, the recording medium does not need to be limited to medium in the form of a sheet. For example, it may be an OHP sheet, or the like.

The sheets P in the selected cassette 105, 106, 107, or 108 are fed out of the cassette, while being separated, into the main assembly, by the separation-conveyance roller 105A, 106A, 107A, or 108A, respectively, and are conveyed one by one to the pair of registration rollers 110 by way of the sheet conveyance path 109. Then, each sheet P is conveyed to the transfer station in synchronism with the rotation of the photosensitive drum 104 and scanning timing of the optical station 103. In the transfer station, the electrostatic image formed on the photosensitive drum 104 is developed with the use of toner as developer, and the resultant developer image (toner image) is transferred onto the sheet P by the transfer charger 111. Then, the sheet P bearing the toner image is separated from the photosensitive drum 104 by the separation charger 112.

Thereafter, the sheet P is conveyed to the fixation station 114 by the conveying means 113. In the fixation station 114, the toner image on the sheet P is fixed to the sheet P by the application of heat and pressure. Thereafter, when the copying machine is in the single-sided mode, the sheet P is conveyed through the reversing station 115, and is discharged into the delivery tray 117 by the pair of discharge rollers 116. When the machine is in the two-sided mode, the sheet P is directed to the reconveyance paths 119 and 120 by the reversing station 115, and is conveyed back to the pair of registration rollers 110 through the reconveyance paths 119 and 120. Then, the sheet P is conveyed through the sheet conveyance paths through which it has just been conveyed to form an image on one surface of the sheet P, and then, is discharged into the delivery tray 117.

When the copying machine is in the multilayer mode, the sheet P is partially discharged from the apparatus main assembly, by the pair of discharge rollers 116 through the reversing station 115. That is, with such a timing that the trailing edge of the sheet P has passed the flapper 118, but the sheet P is still nipped by the pair of discharge rollers 116, control is executed to switch the position of the flapper 118 and start rotating in reverse the discharge rollers 116, in order to feed the sheet P back into the apparatus main assembly 100. Therefore, the sheet P is conveyed to the registration rollers 110 through the reconveyance paths 119 and 120. Then, it is conveyed through the sheet conveyance paths through which it has just been conveyed to form an image on one surface of the sheet P, and is discharged into the delivery tray 117.

In the apparatus main assembly 100 structured as described above, there are disposed the developing apparatus 201 as a developing means, a cleaning apparatus 202, a primary charger, etc., around the photosensitive drum 104. The developing apparatus 201 is an apparatus for developing an electrostatic latent image with the use of developer (toner).

Incidentally, an electrostatic latent image is formed on the peripheral surface of the photosensitive drum 104 by exposing the uniformly charged portion of the peripheral surface of the photosensitive drum 104, in the optical station 103, based on the image formation data of the original 101. The developing apparatus 201 employs a developer supply container 1, which is for supplying the developing apparatus 201 with toner as developer, and which is removably mountable in the main assembly 100 by a user. It should be noted here that not only is the present invention applicable to a developer supply container which supplies the apparatus main assembly 100 only with toner, but also a developer supply container which supplies the apparatus main assembly 100 with the combination of toner and carrier. This embodiment, however, will be described with reference to the former.

The developing apparatus 201 is provided with a toner hopper 201*a* as a toner storing means, and a developing device 201*b*. The toner hopper 201*a* is provided with a stirring member 201*c* for stirring the toner delivered thereto from the developer supply container 1. After the toner is stirred by the stirring member 201*c*, it is sent to the developing device 201*b* by the magnetic roller 201*d*. The developing device 201*b* has a development roller 201*f* and a toner sending member 201*e*. The toner having been sent to the developing device 201*b* by the magnetic roller 301*d* from the toner hopper 201*a* is sent to the development roller 201*f* by the toner sending member 201*e*, and then, is supplied to the photosensitive drum 104 by the development roller 201*f*. The cleaning apparatus 202 is an apparatus for removing the toner particles remaining on the photosensitive drum 104. The primary charger 203 is for charging the photosensitive drum 104.

Figure 2:
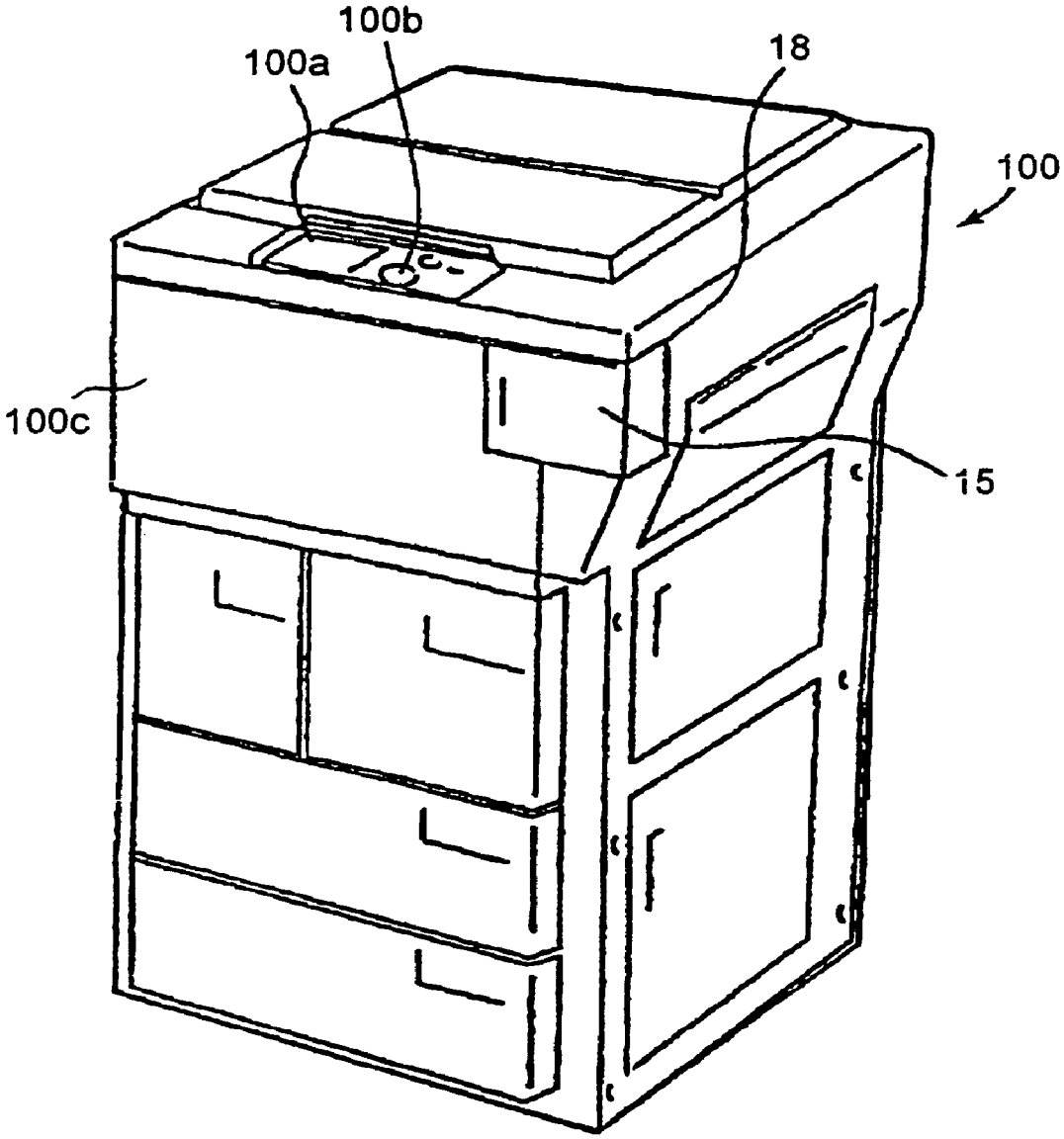
FIG. 2 is a perspective view of the entirety of the typical image forming apparatus.
Figure 3:
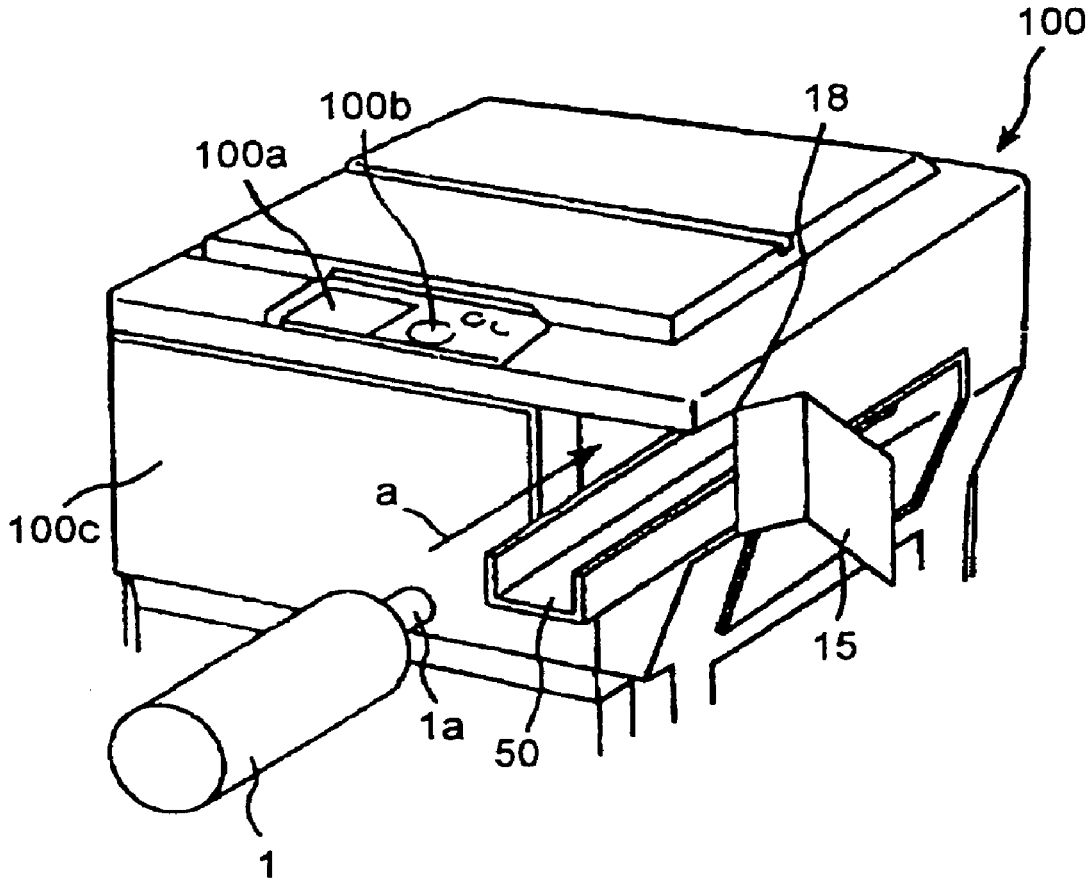
FIG. 3 is a perspective view of the developer supply container tray, and its adjacencies, of the image forming apparatus, showing how a developer supply container is mounted into, or removed from the tray.

As the developer supply container replacement front cover 15 (which hereinafter may be simply referred to as "front cover"), which is a part of the external housing of the image forming apparatus shown in FIG. 2, and which is for replacing the developer supply container in the apparatus main assembly 100, is opened by a user as shown in FIG. 3, the container tray 50, which is a part of the developer supply container mounting means, is pulled out to a predetermined position by a driving mechanism (unshown). The developer supply container 1 is to be mounted on the developer supply container tray 50. When it is necessary for a user to remove the developer supply container 1 from the apparatus main assembly 100, the user is to pull the container tray 50 out of the apparatus main assembly 100, and remove the developer supply container 1 on the container tray 50. The developer supply container replacement front cover 15 (which hereinafter may be simply referred to as "container replacement front cover") is a cover dedicated to the mounting or removal (replacement) of the developer supply container 1, and therefore, is to be opened or closed only for mounting or removing the developer supply container 1. Incidentally, for the maintenance of the apparatus main assembly 100, the front cover 100*c* is to be opened. The provision of the developer supply container tray 50 is not mandatory; the image forming apparatus may be structured so that the developer supply container 1 can be directly mounted into, or removed from, the apparatus main assembly 100.

[Toner Replenishment Operation]

Figure 4:
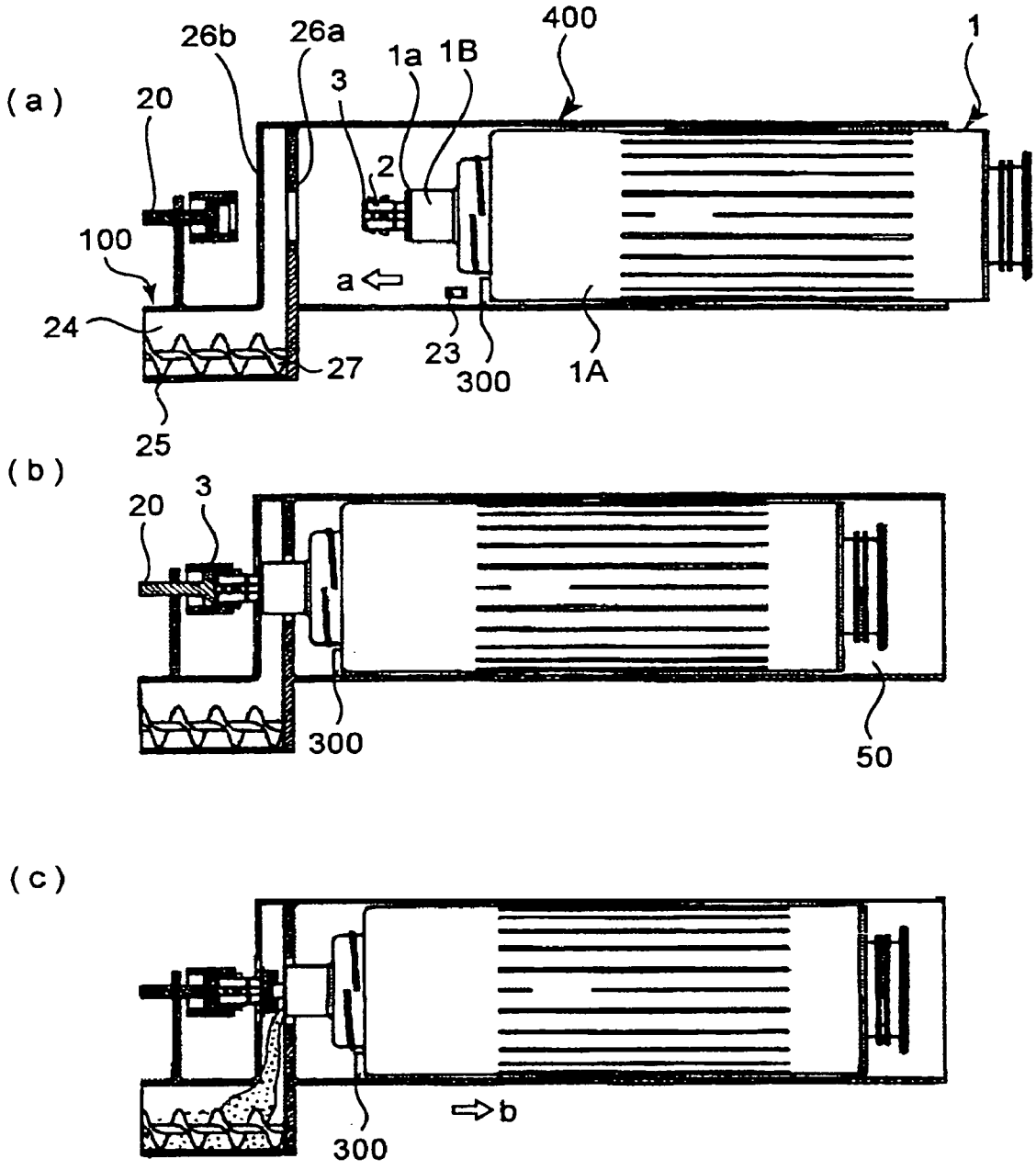
FIG. 4 is a schematic, partially sectional side view of the developer supply container and the driving portion of the main assembly of the image forming apparatus, showing how the developer supply container is mounted into the developer supply tray of the main assembly.
Figure 5:
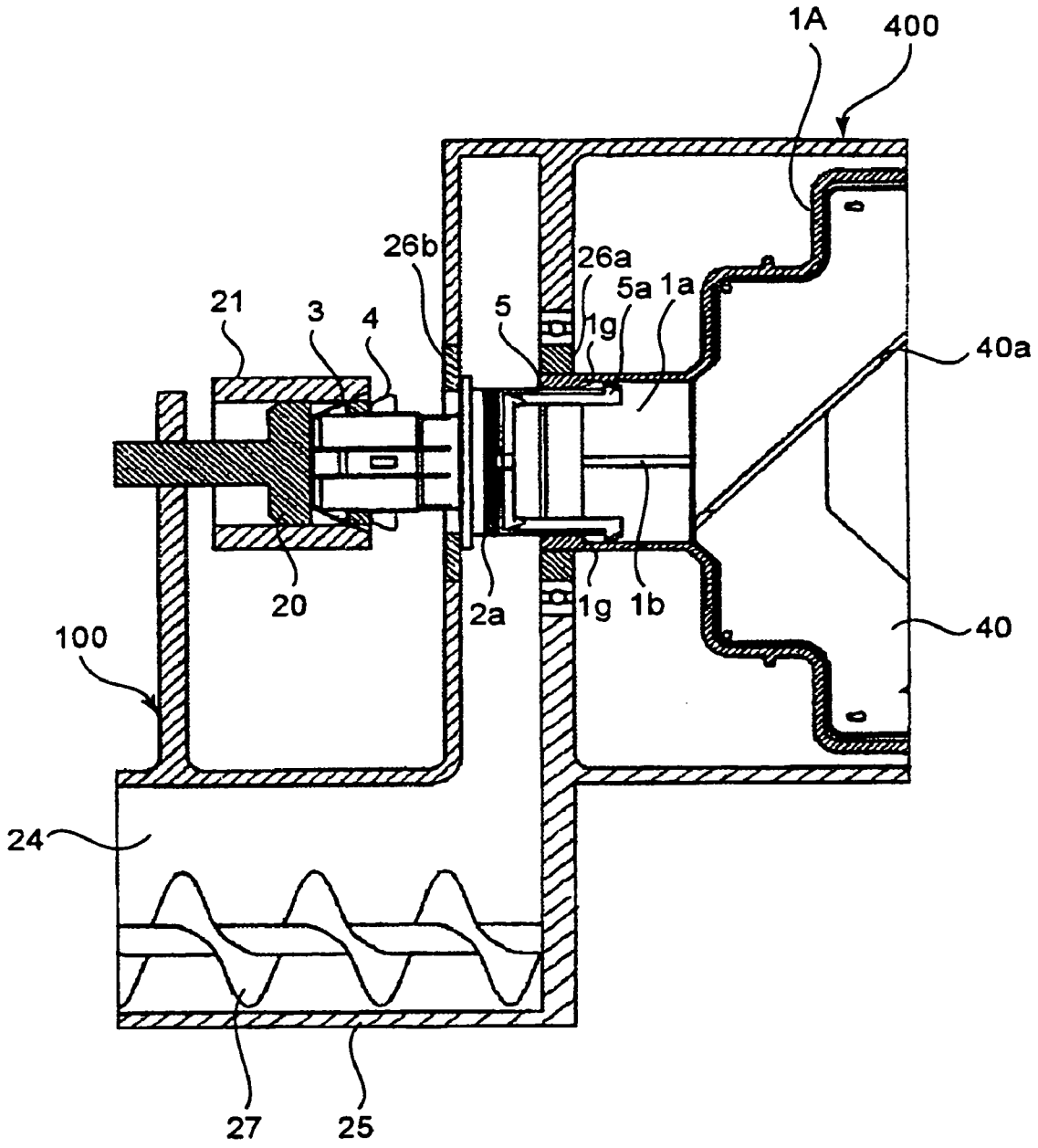
FIG. 5 is a schematic partially sectional side view of the developer supply container, showing how the driving portion of the main assembly of the image forming apparatus is coupled with the sealing member of the developer supply container.

First, referring to FIGS. 4(*a*)–4(*c*), and FIG. 5, the operation for supplying the developing apparatus 201 with toner, using the developer supply container 1 (toner bottle or toner supply container) in this embodiment will be described. FIGS. 4(*a*)–4(*c*) are drawings for showing in steps the process for supplying the apparatus main assembly 100 with toner by inserting the developer supply container 1 in this embodiment into the apparatus main assembly 100. FIG. 5 is an enlarged sectional view of the essential portion of the developer supply container 1 in accordance with the present invention, the sealing member of which has just engaged with the image forming apparatus main assembly 100, having thereby readied the developer supply container 1 for toner delivery.

Referring to these drawings, the apparatus main assembly 100 is provided with a toner supplying apparatus (developer supplying apparatus) 400. It also is provided with a driving portion 20 as a driving member which is coupled with the developer supply container 1 in such a manner that rotational force is transmitted to the developer supply container 1. The driving portion 20 is rotationally supported by an unshown bearing or the like, and is rotationally driven by an unshown motor with which the apparatus main assembly 100 is provided.

The apparatus main assembly 100 is also provided with a partitioning wall 25, which constitutes the wall of the toner delivery path 24 which leads to the toner hopper 201*a*. The partitioning wall is fitted with sealing members 26*a* and 26*b* which support the developer supply container 1 by a part of the developer supply container 1, and which seal between the exterior and interior of the toner delivery path 24. The toner delivery path 24 is provided with a screw 27 for conveying the supplied toner to the toner hopper 201*a*.

FIG. 4(*a*) shows the developer supply container 1 which has just begun to be inserted into the apparatus main assembly 100. The developer supply container 1 comprises: a cylindrical large diameter portion 1A, and a cylindrical toner outlet port (small diameter portion) 1*a*. The toner outlet port 1*a* projects from one of the end walls of the large diameter portion 1A, and its axial line roughly coincides with the rotational axis of the large diameter portion 1A. The end of the toner outlet port 1*a* has an opening through which developer is discharged. When the developer supply container 1 is not in connection with the driving portion of the apparatus main assembly 100, this opening remains sealed with a sealing member 2, which also functions as a driving force transmitting member, and which will be described later.

Referring to FIG. 4(*b*) which shows the developer supply container 1 having just been coupled with the driving portion 20 of the apparatus main assembly 100, the sealing member 2 is provided with a resinous snap-fitting portion, which is located at the tip of the sealing member 2. When the developer supply container 1 is in the state shown in FIG. 4(*b*), the sealing member locking projection 3 of the snap-fitting portion of the sealing member 2 is in the locking hole of the driving portion 20 of the apparatus main assembly 100, being locked therein. This engagement between the driving portion 20 and projection 3 occurs as a user inserts the developer supply container 1 into the apparatus main assembly 100. More specifically, as the user inserts the developer supply container 1, the top surface (contact pressure catching portion) of the locking projection 3 of the sealing member 2 comes into contact with the driving portion 20. Then, as the user inserts the developer supply container 1 further, the snap-fitting portion, which is flexible, is bent (displaced) downward along with the locking projection 3. Therefore, as the pressure applied to the locking projection 3 by the contact between the contact pressure catching portion of the projection 3 is deleted by the further insertion of the sealing member 2, the snap-fitting portion of the sealing member 2, which is supporting the locking projection 3, is restored to the original state by its own resiliency, that is, comes out of the state in which it was kept depressed, ending the process in which the sealing member 2 is snap-fitted in the driving portion 20 of the apparatus main assembly 100; the former is locked with the latter.

Figure 8:
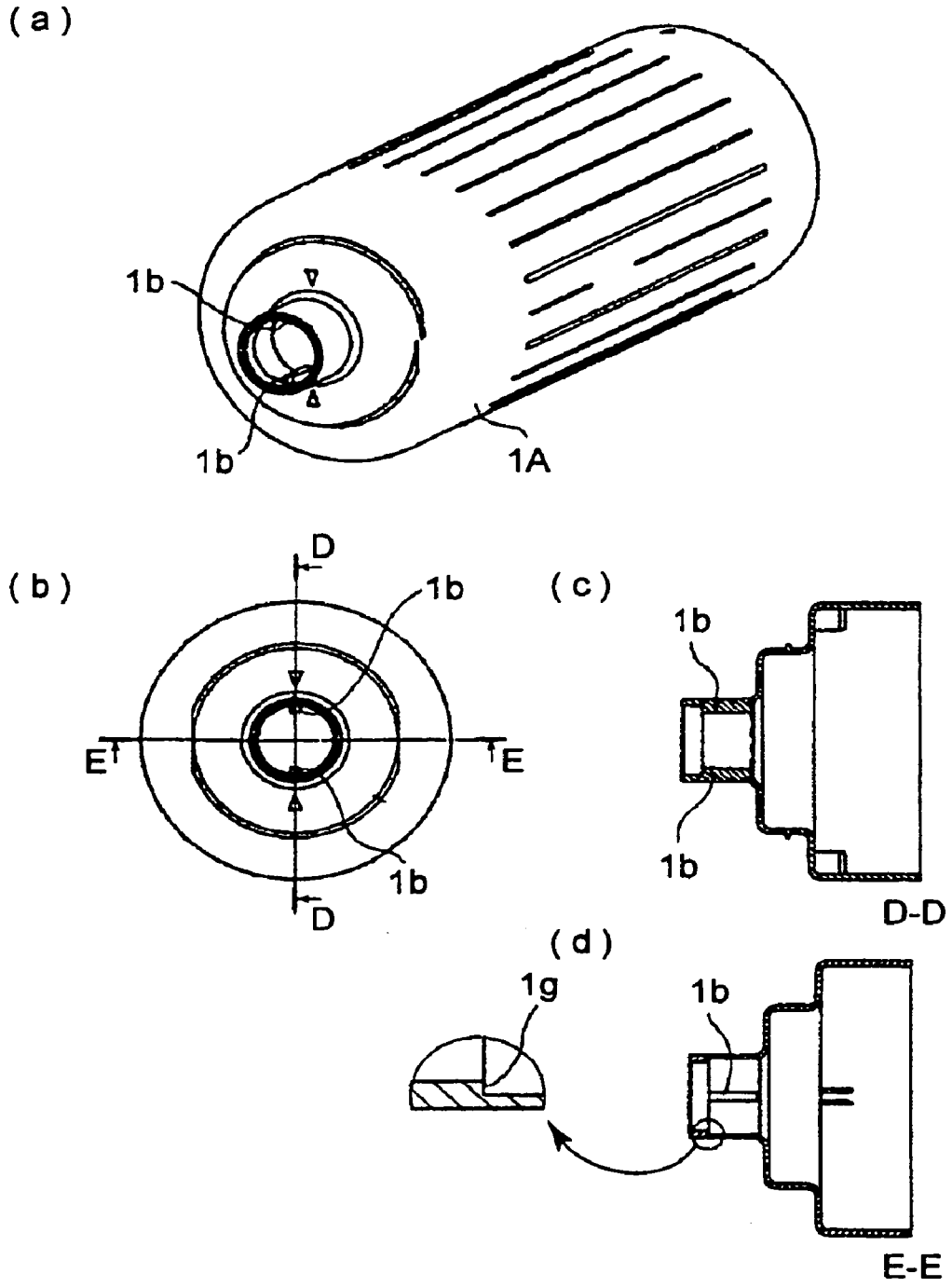
FIG. 8 is a drawing of the driving force receiving portion of the container proper of the developer supply container.
Figure 9:
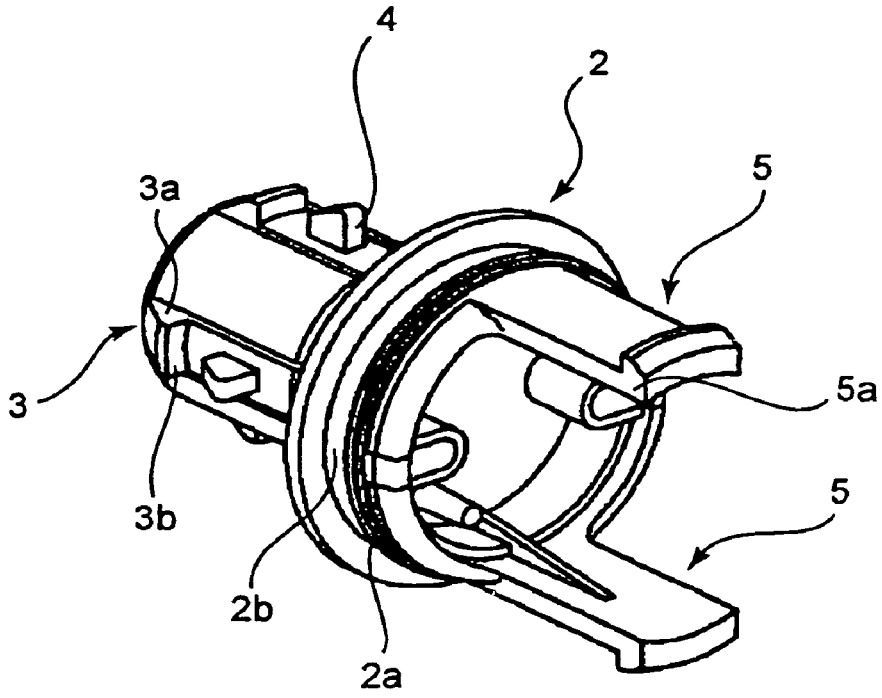
FIG. 9 is a perspective view of the sealing member, in the first embodiment of the present invention, having a driving force transmitting portion.
Figure 9:
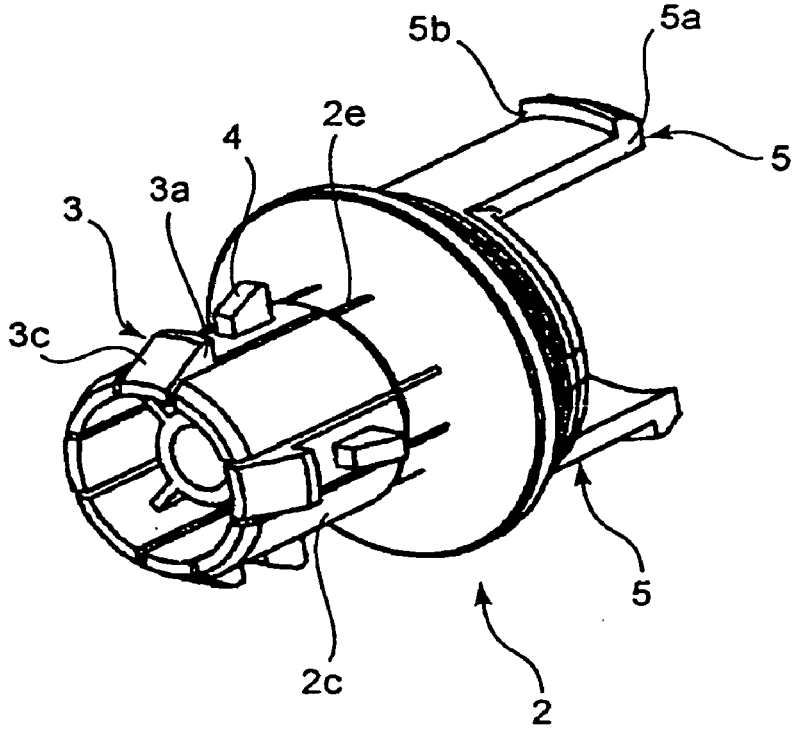

During this engagement, the surface 3*b* (FIG. 8 and FIG. 9(*e*)), as the locking surface 3*b* of the locking projection 3 of the sealing member 2 is engaged with the wall of the locking hole of the driving portion 20, which is perpendicular to the thrust direction (axial direction) in which the sealing member 2 is inserted into the locking hole of the driving portion 20; in other words, the sealing member 2 is locked in place in terms of the thrust direction. Therefore, unless the locking projection 3 is disengaged from the wall of the locking hole of the driving portion 20, the sealing member 2 remains positioned in the locking hole of the driving portion 20 (small amount of play may be present).

FIG. 4(*c*) shows the sealing member 2 and driving portion 20, which have finished coupling with each other, being ready for toner delivery. More specifically, as the container replacement front cover 15 is closed further after the engagement of the sealing member 2 and driving portion 20, the sliding member 300 is moved backward, that is, in the direction indicated by an arrow mark b by the closing movement of the cover 15. As a result, the developer supply container 1 is also moved backward. However, the sealing member 2 is locked in by the apparatus main assembly. Therefore, the sealing member 2 is partially pulled out of the developer supply container 1, unsealing thereby the outlet 1*a*, that is, readying the developer supply container 1 for toner delivery.

As the unshown motor is started when the developer supply container 1 is in the above described state, rotational driving force is transmitted from the driving portion 20 of the apparatus main assembly 100 to the sealing member 2, rotating thereby the sealing member 2. As the sealing member 2 is rotated, the driving force transmitting portion 5 which projects from the sealing member 2 toward the toner outlet 1*a*, transmits the driving force to the driving force receiving portion 1*b* of the developer supply container 1, which is on the inward side of the outlet 1*a*. As a result, the developer supply container 1 is rotated to convey the toner therein, and discharge the toner therefrom. In other words, not only does the sealing member 2 seal the toner delivery outlet 1*a*, but it also has the function of receiving from the apparatus main assembly, the force for driving the developer supply container 1, and the function of transmitting the received driving force to the developer supply container 1.

The developer supply container 1 is rotationally supported by bottle supporting rollers 23 with which the container tray 50 is provided. Therefore, it requires only a small amount of driving torque for the developer supply container 1 to be smoothly rotated. There are four bottle supporting rollers 23 strategically located at four different points, one for one, to saddle the bottle proper 1A. The bottle supporting rollers 23 are rotationally attached to the toner supplying apparatus 400 of the apparatus main assembly 100. As the developer supply container 1 is rotated as described above, the toner in the developer supply container 1 is gradually discharged through the outlet 1*a*, and the discharged toner is conveyed to the toner hopper 210*a* of the apparatus main assembly 100, by the screw 27 in the toner conveyance path 24; the apparatus main assembly 100 is supplied with toner.

[Method for Replacing Developer Supply Container]

Next, the method for replacing the developer supply container in accordance with the present invention will be described. As virtually the entirety of the toner in the developer supply container 1 is consumed by the image formation process, the absence of toner in the developer supply container 1 is detected by a toner absence detecting means (unshown) with which the apparatus main assembly 100 is provided, and a user is informed of this situation through an information displaying means 100*b* (FIG. 2) such as a liquid crystal display.

The developer supply container 1 in this embodiment can be replaced by a user alone. The procedure for replacing the developer supply container 1 is as follows.

First, the closed container replacement front cover 15 is to be opened: it is to be rotated about the hinge 18 to the position shown in FIG. 3. As the front cover 15 is opened, the bottle proper 1A which has been in the state shown in FIG. 4(*c*) is moved in the direction indicated by an arrow mark a, that is, the direction opposite to the direction indicated by an arrow mark b, in FIG. 4(*a*), by the means for opening or closing the toner supplying portion, which is moved by the movement of the front cover 15, and which will be described later. As a result, the sealing means 2, which has been kept partially pulled out of the bottle proper 1A, having therefore not been sealing the toner delivery opening 1*a*, is pressed into the toner outlet 1*a*, sealing thereby the toner outlet 1*a* (FIG. 4(*b*)). Incidentally, during this step, the sealing member 2 remains engaged with the image forming apparatus main assembly. Thereafter, the sealing member disengagement ring is moved to depress the sealing member unlocking projection of the sealing member 2. As a result, the sealing member locking projection of the sealing member 2 is disengaged from the wall of the locking hole of the driving portion 20, making it possible for the bottle proper 1A is to be retracted in its lengthwise direction, to complete the process for uncoupling the sealing member 2 from the image forming apparatus main assembly 100.

Thus, the user is allowed to pull out the empty developer supply container 1, which has been disengaged from the apparatus main assembly 100, in the arrow b direction, that is, direction opposite to the arrow a direction shown in FIG. 4(*a*). Thereafter, the user is to insert a new developer supply container 1 into the apparatus main assembly 100 in the arrow a direction in FIG. 4(*a*), and close the container replacement front cover 15. As the front cover 15 is closed, the sealing member 2, which is in engagement with the image forming apparatus main assembly, is moved in the direction to be pulled out of the container proper 1A, by the means for opening or closing the outlet 1*a*, which is moved by the closing movement of the front cover 15, as described above; the toner outlet 1*a* is unsealed (FIG. 4(*c*)). This is the procedure for replacing the employ developer supply container 1 in the main assembly 100.

[Developer Supply Container]

Next, referring to FIGS. 6 and 7, the developer supply container 1 in this embodiment will be described. The developer supply container 1 is roughly cylindrical, and essentially comprises a bottle proper 1A and a supply delivery port 1B. The former is larger in diameter than the latter. The supply delivery port 1B projects from the approximate center of one end of the bottle proper 1A, and the end portion of the port 1B has the outlet 1*a*. The port is provided with the sealing member 2 (coupling-driving member) for sealing the outlet 1*a*. As will be understood from the preceding description made with reference to FIGS. 4(*a*)–4(*c*), the sealing member 2 is structured so that it will be slidingly moved, only in relative terms, in the lengthwise direction of the developer supply container 1 (arrow a direction arrow b direction) by the closing or opening movement of the front door 5, unsealing or sealing thereby the outlet 1*a*.

The tip portion of the sealing member 2 is cylindrical, and has the locking projection(s) 3, and the projection(s) 4 for disengaging the locking projection(s) 3 from the driving portion 20 of the apparatus main assembly. This cylindrical portion of the sealing member 2, which has the projections 3 and 4, is structured to be flexible; it is given the so-called snap-fitting structure (which has a plurality of slits which extend from base of cylindrical portion to tip of cylindrical portion, helping (enhancing) thereby elastic deformation of cylindrical tip portion of sealing member; which will be described later). The locking projection(s) 3 engages with the driving portion 20 so that rotational driving force is transmitted to the developer supply container 1. The structure of the sealing member 2 will be described later in detail.

First, referring to FIG. 6, the internal structure of the developer supply container 1 will be described. As described above, the developer supply container 1 is roughly cylindrical, and is roughly horizontally placed in the apparatus main assembly 100. It is structured so that it will rotate by receiving rotational driving force from the apparatus main assembly 100.

There are a baffle member 40 and a plurality of diagonal ribs 40*a* in the bottle proper 1A. The baffle member 40 is in the form of a plate, and conveys the toner in the bottle proper toward the outlet 1*a*. The diagonal ribs 40 are attached to both the front and reverse surfaces of the baffling member 40, being tilted at a predetermined angle relative to the axial line of the developer supply container 1. One of the diagonal ribs 40*a* is placed in contact with the edge of the outlet 1*a* so that the toner is discharged from the bottle proper by this rib 40*a* placed in contact with the edge of the outlet 1*a*, through the outlet 1*a*, after being conveyed in the bottle proper toward the opening of the outlet 1*a*. The principle of the toner conveyance in the bottle proper and then principle of the toner discharge from the bottle proper are as follows. As the developer supply container 1 is rotated, the body of toner scooped up by the baffle member 40 due to the rotation of the developer supply container 1 slides down on the surface of the baffle member 40, while being guided toward the outlet 1*a* by the diagonal ribs 40*a*. With the repetition of this sequence, the toner in the developer supply container 1 is gradually conveyed, while being stirred, and eventually discharged through the outlet 1*a*. The baffle member 40 in the form of a plate is not an integral part of the developer supply container 1. It is held to the container proper 1A by baffle member holding ribs 51, and rotates with the container proper 1A.

The present invention does not limit the internal structure of the developer supply container 1 to that in this embodiment. In other words, there is no limitation to the internal structure (shapes and structures of internal components) of the bottle proper from which toner is discharged, as long as toner is discharged as the developer supply container 1 receives driving force from the image forming apparatus main assembly. For example, the internal structure for conveying toner may be as shown in FIG. 7. This bottle in FIG. 7 is well known as a spiral bottle, because it has a spiral rib 1*c* attached to the internal surface of the bottle proper of the toner supply container 1. Thus, as the toner supply container 1 is rotated, the toner therein is slid along the spiral rib 1*c*, being therefore gradually conveyed in the axial direction, and is discharged from the toner supply container 1 through the outlet 1*a* located at one end of the toner supply container 1.

<Driving Force Receiving Portion>

Next, referring to FIG. 8, the bottle proper 1A will be described. The bottle proper 1A has the outlet 1*a*, which is located at one of the lengthwise ends of the bottle proper 1A. The outlet portion 1*a* has a plurality of driving force receiving portions 1*b*, which are integral parts of the bottle proper 1A, and which are on the internal surface of the outlet portion 1*a*. The driving force receiving portion(s) 1*b* functions to rotate the bottle proper 1A by receiving driving force from the driving force transmitting portion(s) 5 of the sealing member 2, which will be described later. The outlet portion 1*a* in this embodiment has a pair of driving force receiving portions 1*b* positioned in a manner to oppose each other as are the driving force transmitting portions 5. The number, shape, and measurements (height, length, etc.) of the driving force receiving portion(s), and the locations therefor, are optional; they do not need to be limited.

As shown in detail in FIG. 8, the internal surface of the outlet portion 1*a* has a step 1*g*, the riser portion of which regulates the distance by which the sealing member 2 is allowed to slide, by engaging with the locking surface 5*b* of the driving force transmitting portion 5, which will be described later.

[Sealing Member]

Next, referring to FIGS. 9–11, the structure of the sealing member 2, which also functions as a coupler which can be coupled with, or decoupled from, the driving portion 20 of the image forming apparatus main assembly will be described.

FIGS. 9(*a*) and 9(*b*) are perspective views of the sealing member 2, as seen from the right and left sides, respectively. FIG. 10(*a*) is a front view of the sealing member in this embodiment; FIG. 10(*b*), a left side view thereof; FIG. 10(*c*), right side view thereof; FIG. 10(*d*), a top view thereof; and FIG. 10(*e*) is a sectional view thereof, at plane A—A in FIG. 10(*b*).

Figure 11:
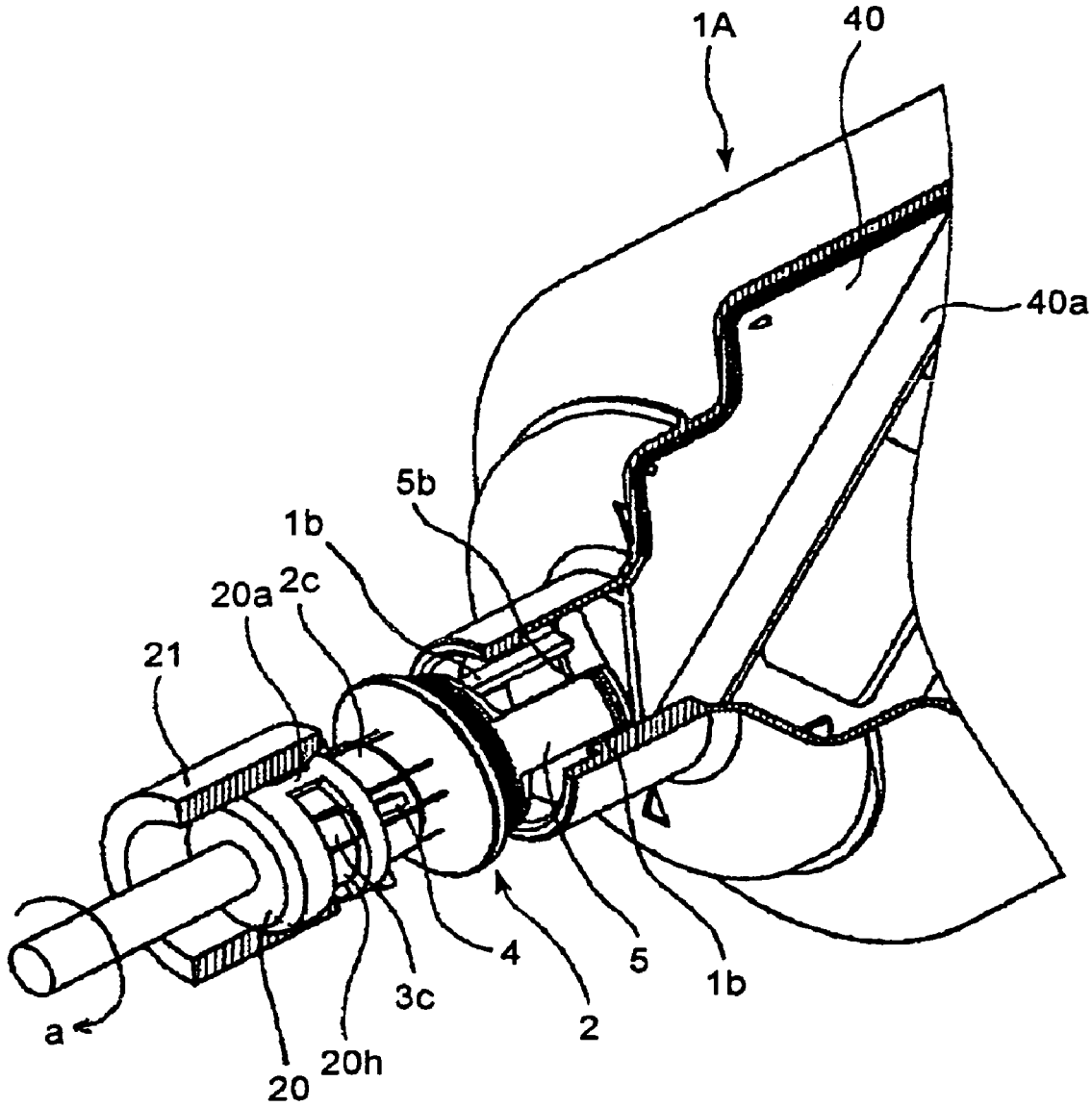
FIG. 11 is a partially sectional perspective view of the driving portion of the main assembly of the image forming apparatus, and the sealing member, and its adjacencies, of the developer supply container.

FIG. 11 is a sectional perspective view of the driving portion 20 of the apparatus main assembly, and the outlet portion of the toner supply container in accordance with the present invention, which is in engagement with the driving portion 20, and through which toner is being delivered. Referring to this drawing, the sealing member 2 is provided with a sealing portion 2*b* capable of sealing or unsealing the outlet portion 1*a* of the toner supply container 1, and a cylindrical coupler portion 2*c* capable of coupling or decoupling with the driving portion 20 of the apparatus main assembly. The sealing member 2 is also provided with a pair of seals 2*a*, which are fitted around the peripheral surface of the sealing portion 2*b*. The external diameter of each seal 2*b* is made to be greater by a proper amount than the internal diameter of the outlet portion 1*a*. These seals 2*a* are to seal the outlet portion 1*a* by being compressed by the outlet portion 1*a* as the sealing member 2 is pressed into the outlet portion 1*a*. Therefore, they are desired to have a proper amount of elasticity. The seals in this embodiment are formed of elastomer, and are formed by two color injection molding.

The sealing member 2 performs several essential functions that must be performed in order for the toner supply container to properly function. The functions which must be performed by the sealing member 2 are as follows:

1) to engage with the image forming apparatus main assembly to unseal the toner supply container 1;

2) to receive rotational driving force from the image forming apparatus main assembly;

3) to transmit the received driving force to the bottle proper;

4) to be disengaged from the image forming apparatus main assembly.

In other words, the sealing member 2 is required to perform several important functions by itself, being therefore given the above described unique structure.

Hereinafter, each of the characteristic aspects of the structure of the sealing member 2 for performing the above described functions will be described in detail.

[Coupler Portion]

The sealing member 2 in this embodiment has a cylindrical coupler 2*c*, which is coupled with the driving portion 20 of the image forming apparatus main assembly by the closing movement of the front door 5, performing thereby not only the function of unsealing the toner supply container, but also the function of receiving the rotational force from the driving portion 20 after unsealing the toner supply container.

The cylindrical coupler 2*c* of the sealing member 2 has a plurality of snap-fitting portions formed of resin. Each snap-fitting portion has the locking projection 3. It is structured to be elastically deformable, making it easier for the locking projection 3 to be depressed inward of the coupler 2*c*, in terms of the radial direction of the coupler 2*c*, as the toner supply container is inserted further into the image forming apparatus main assembly after the slanted surface 3*c* of the locking projection 3 comes into contact with the driving portion 20 when the toner supply container is inserted into the main assembly. The snap-fitting portion also has the locking projection disengaging projection 4. Therefore, the projection 4 can be easily depressed inward of the coupler 2*c*, in terms of the radius direction of the coupler 2*c*, as can the locking projection 3. In other words, the projections 3 and 4 are integral parts of the cylindrical coupler 2*c*, more specifically, integral parts of the snap-fitting portion of the coupler 2*c*.

On the other hand, the driving portion 20 of the apparatus main assembly 100 is provided with the locking hole 20*h*, which is structured so that the projections 3 of the sealing member 2 will become locked with the driving portion 20, that is, the diagonal surface 3*b* of the locking projection 3 will come into contact with the wall of the hole 20*h* of the driving portion 20. The driving portion 20 is also provided with a plurality of ribs 20*a* for rotationally driving the developer supply container 1. These ribs come into contact with the driving force receiving surfaces 3*a* of the projections 3, one for one, and transmit rotational driving force to the sealing member 2 after the engagement of the projections 3 into the holes 20*h*.

The locking projection 3 of the sealing member 2 is an integral part of the snap-fitting portion of the coupler 2*c*; the coupler 2*c* is for receiving the developer supply container driving force from the apparatus main assembly 100, and is an integral part of the sealing member 2. The locking projection 3 projects outward from the peripheral surface of the coupler portion 2*c* of the sealing member 2, in the radial direction of the coupling portion 2*c*. It has the driving force receiving surface 3*a* by which the sealing member 2 receives rotational driving force from the apparatus main assembly, and a locking surface 3*b*, which engages with the one of the walls of the locking hole 20*h* of the driving portion 20 as the coupling portion 2*c* of the sealing member 2 snap-fits in the driving portion 20. Further, the coupler 2*c* is provided with a plurality of slits 2*e*, which render the portions of the coupler 2*c* having the projections 3, one for one, flexible enough to allow the projections 3 to snap-fit into the locking holes 20*h*, one for one, of the driving portion 20. In other words, with the presence of these slits 2*e*, as the projections 3 or 4 are depressed in the direction indicated by an arrow mark c in FIG. 10(*e*), the portions of the coupler 2*c* having the projections 3 and 4 are allowed to easily deform temporarily in the arrow mark direction (and then, return to their original positions as the pressure on the projections 3 and 4 is removed).

In other words, the sealing member 2 performs three different functions: its coupler 2*c* connects the developer supply container 1 with the apparatus main assembly; its driving force receiving surface 3*a* receives rotational driving force from the apparatus main assembly and transmits the received rotational force to the developer supply container 1; and its locking surface 3*b* prevents the sealing member 2 from being completely pulled out of the bottle proper 1A when the sealing member 2 is slidingly moved, in relative terms, to unseal the outlet 1*a*.

The leading end of the locking projection 3 is slanted (diagonal surface 3*c*) so that when the developer supply container 1 is mounted into the apparatus main assembly 100, the sealing member 2 can be smoothly inserted into the driving portion 20. As will be better understood referring to FIG. 11, the diagonal surface 3*c* is the surface by which the locking projection 3 is pressed radially inward of the coupler 2*c*. More specifically, as the sealing member 2 is pressed into the driving portion 20, first, the diagonal surface 3*c* comes into contact with the edge of the wall of the driving portion 20. Then, as the sealing member 2 is pressed further into the driving portion 20, the diagonal surface 3*c* causes the locking projection 3 to be depressed into the coupler 2*c* in the radius direction of the coupler 2*c*, allowing the sealing member 2 to be inserted further into the driving portion 20. Thereafter, as the sealing member 2 is inserted further into the driving portion 20, the locking projection 3 is depressed further inward of the coupler 2*c* while being moved deeper into the driving portion 20. As a result, the diagonal surface 3*c* loses contact with the wall of the driving portion 20; the top surface of the locking projection 3 comes into contact with the wall of the driving portion 20. Then, as the sealing member 2 is inserted further into the driving portion 20, the locking projection 3 moves into the locking hole 20*h* of the driving portion 20, allowing the flexible portion of the coupler 2*c*, which has the locking projection 3, to spring back into its normal position, locking the sealing member 2 (projection 3) with the image forming apparatus main assembly 100 (driving portion 20).

After the completion of the engagement between the coupler 2*c* of the sealing member 2 and the driving portion 20, the sealing member 2 is moved (slid) in the direction to be pulled out of the bottle proper 1A of the developer supply container 1, by the final stage of the aforementioned closing movement of the front door 5. As a result, the outlet 1*a* is unsealed, that is, the developer supply container 1 is readied for toner discharge. Incidentally, in this embodiment, the outlet 1*a* is automatically unsealed or sealed, by retracting or forwarding the bottle proper 1A, in terms of the direction in which the developer supply container 1 is mounted into, or removed from, the apparatus main assembly 100, with the sealing member 2 locked in position by the apparatus main assembly 100.

<Unlocking Projection>

Next, the unlocking projection 4, or the decoupling projection, paired with the locking projection 3, or coupling projection, will be described. The decoupling projection 4 is a projection for disengaging the sealing member 2 from the driving portion 20 of the apparatus main assembly 100 in order to replace the toner supply container 1; the sealing member 2 must be disengaged from the driving portion 20 in order to remove the toner supply container from the apparatus main assembly 100 and place a new (another) one in the apparatus main assembly 100.

The decoupling projection 4 is positioned to disengage the coupling projection 3 from the driving portion 20. More specifically, as the decoupling ring 21 of the image forming apparatus main assembly is slid toward the bottle proper 1A, the decoupling projection 4 is depressed inward of the coupler 2*c* in the radius direction of the coupler 2*c*, by the decoupling ring 21. As the result, the portion of the coupler 2*c*, which has the coupling projection 3 and decoupling projection 4, is elastically bent inward of the coupler 2*c*, causing the coupling projection 3 to be moved out of the locking hole 5*h* of the driving portion 20 (disengaged from the driving portion 20).

The coupler 2*c* of the sealing member 2 in this embodiment is provided with four pairs of coupling projections 3 and decoupling projections 4, one pair for each of the four flexible portions created by providing the coupler 2*c* with the four slits which evenly divide the coupler 2*c* in terms of the circumferential direction of the coupler 2*c*. However, the number of the pairs of the coupling projections 3 and decoupling projections 4, and the positioning thereof, etc., are optional. They may be only two or three, or more than four.

The details of the coupling and decoupling of the sealing member 2 will be described later with reference to FIGS. 14 and 15.

<Driving Force Transmitting Portion>

Next, the driving force transmitting portion of the sealing member 2, which performs one of the essential functions of the sealing member 2, that is, the function of transmitting driving force from the image forming apparatus main assembly 100 to the bottle proper 1A of the developer supply container 1, will be described in detail.

Figure 10:
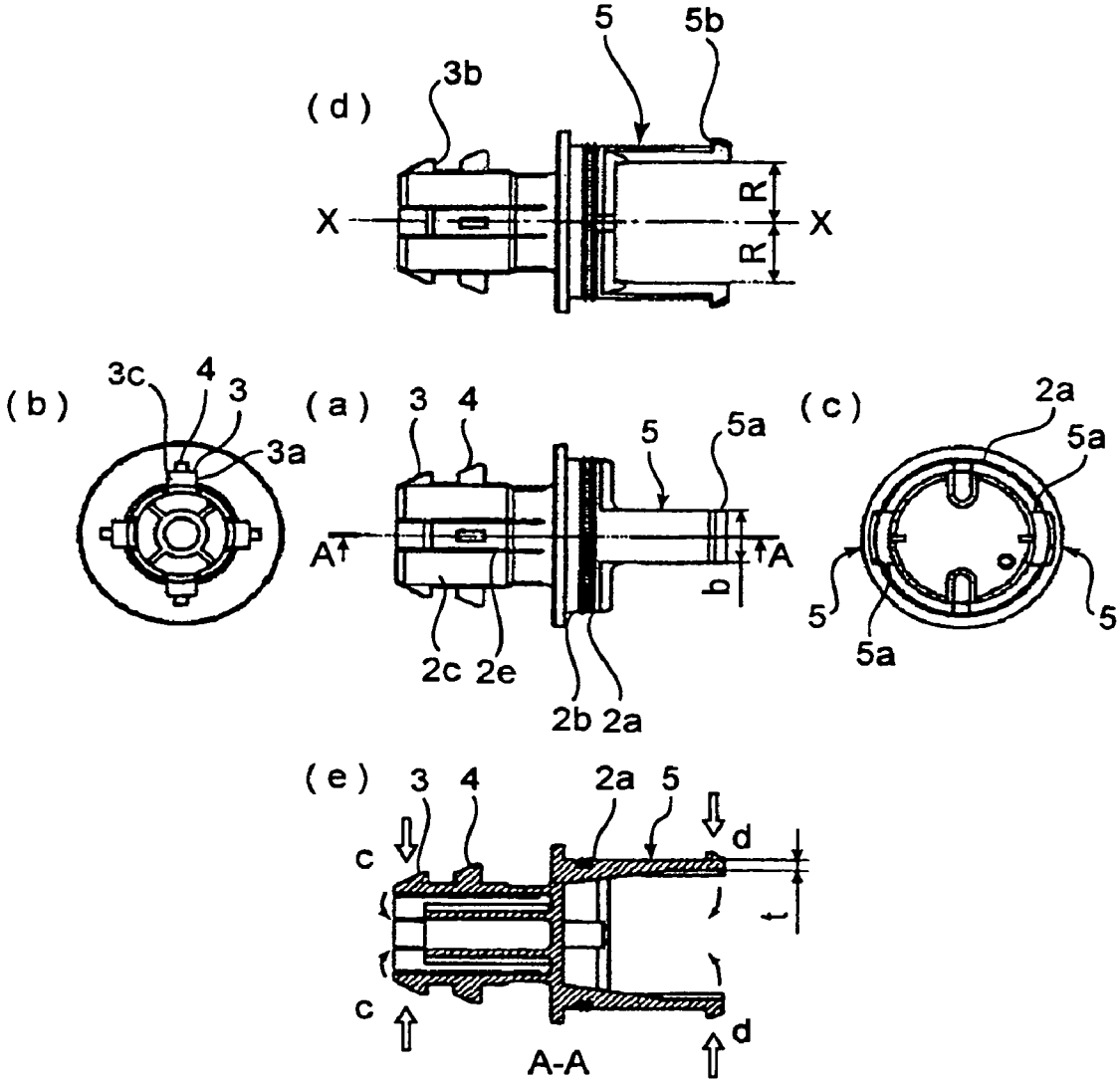
FIG. 10 is a drawing of the sealing member, in the first embodiment of the present invention, having a driving force transmitting portion.

Referring to FIGS. 9 and 10, the sealing member 2 is provided with the driving force transmitting portion(s) 5, which constitutes one of the lengthwise end portions of the sealing member 2, and which is for transmitting rotational driving force from the image forming apparatus main assembly 100 to the container proper 1A of the developer supply container 1. The driving force transmitting portion 5 comprises a plurality of virtually rectangular plates, which have such a curvature that matches the curvature of the internal surface of the outlet portion of the bottle proper 1A, and which extend in the axial direction of the sealing member 2 from the sealing portion 2*b* along the internal surface of the outlet portion. Each driving force transmitting portion 5 is structured so that there will be a certain amount of play between the driving force transmitting portion 5 and the driving force receiving portion 1*b* of the developer supply container 1, in terms of the circumferential direction of the developer supply container 1. In other words, the driving transmitting portion 5 and driving force receiving portion 1*b* are structured so that, during the period between when the driving force transmitting portion 5 begins to be rotated by the driving portion 20 of the apparatus main assembly 100 and when the driving force transmitting portion 5 engages with the driving force receiving portion 1*b*, the sealing member 2 is allowed to rotate by a sufficient angle, within the range in which the rotational force received by the sealing member 2 coupled with the driving portion 20 of the apparatus main assembly 100 can be efficiently transmitted to the bottle proper 1A of the developer supply container 1. More specifically, the driving force transmitting portion 5 and driving force receiving portion 1*b* are structured so that the dimension of the locking plate 5*b* of the driving force transmitting portion 5, and the dimension of the driving force receiving portion 1*b*, in terms of the circumferential direction of the developer supply container 1, become as small as possible within the range in which driving force can be satisfactorily transmitted and received between the driving force transmitting portion 5 and driving force receiving portion 1*b*.

Further, in order for driving force to be efficiently transmitted, the sealing member 2 is desired to be provided with a plurality of driving force transmitting portions 5, and the container proper 1A is desired to be provided with a plurality of driving force receiving portions 1*b*, which matches the plurality of driving force transmitting portions 5 in number and position.

The sealing member 2 in this embodiment is provided with a pair of driving force transmitting portions 5, which are positioned to oppose each other with respect to the axial line of the sealing member 2, providing the sealing member 2 with a rotational play of slightly less than 180°. With the provision of the mutually opposing two driving force transmitting portions 5, the sealing member 2 can be kept stable in attitude when the sealing member 2 is in the position in which the outlet 1*a* is unsealed. Therefore, rotational driving force can be reliably transmitted from the sealing member 2 to the container proper 1A.

Thus, when providing the sealing member 2 with two driving force transmitting portions 5, it is desired that the two driving force transmitting portions 5 are positioned so as to roughly oppose each other with respect to the axial line of the developer supply container 1. More specifically, the two driving force transmitting portions 5 are desired to be positioned so that the deviation in angle of the pair of the driving force transmitting portions 5 from their perfectly opposing positions falls within ±10°. With the provision of such a structural arrangement, the same effect as that which can be obtained when the two driving force transmitting portions 5 perfectly oppose each other with respect to the axial line of the developer supply container 1 can be obtained.

In comparison, when providing the sealing member 2 with three driving force transmitting portions 5, it is desired that the three driving force transmitting portions 5 are not positioned in such a manner that two of them are both within 180° from the remaining one.

With the provision of the above described structural arrangement, even if the developer supply container 1, the developer supply container tray 50 (FIGS. 3 and 4) of the apparatus main assembly 100, etc., have slight defects attributable to manufacturing errors, or assembling errors, the rotational force received by the sealing member 2 as a coupler, can be satisfactorily transmitted to the developer supply container 1.

In other words, even if there is a certain amount of deviation in the distance between the axial line of the developer supply container 1 and the point of the developer supply container 1, by which the developer supply container 1 is supported by the container tray 50, due to the manufacturing errors and/or assembly errors, that is, even if the rotational axis of the driving portion 20 of the apparatus main assembly 100 fails to perfectly align with the rotational axis of the developer supply container 1, the deviation can be compensated for by the sealing member 2.

In order for the sealing member 2 to satisfactorily transmit rotational force to the developer supply container 1 while overcoming the above described deviation, the sealing member 2 of the developer supply container 1 and the driving portion 20 of the apparatus main assembly are desired to be structured to allow the sealing member 2 to rotate no less than 30° during the period between when the driving force transmitting portions 5 begin to be rotated by the driving portion 20 of the apparatus main assembly 100 and when the driving force transmitting portions 5 come into contact with the driving force receiving portions 1*b*, one for one, of the container proper 1A of the developer supply container 1.

Each driving force transmitting portion 5 is provided with a driving surface 5*a*, which is one of the lateral surfaces of the driving force transmitting portion 5, and which is for transmitting rotational force in the rotational direction. Driving force is transmitted by the contact between the driving surface 5*a* and the driving force receiving portion 1*b*. The driving force receiving portion 1*b* will be described later.

What is important here is the positioning of each of the driving force transmitting portions 5. Referring to FIG. 10(*d*), the driving force transmitting portion(s) 5 is desired to be positioned as far away as possible form the rotational axis of the sealing member 2, for example, a distance equal to R (a radius of sealing member) away from the rotational axis X—X of the sealing member 2, instead of being positioned in the adjacencies of the rotational axis X—X.

This is for the following reason. In the case of the structural arrangement in accordance with the prior art, in which a square shaft, the rotational axis of which coincides with the rotational axis of the container proper of a developer supply container, is employed as a means for transmitting driving force (referential patent document No. 1), the distance between the rotational axis of the square shaft and the peripheral surface of the square shaft is relatively small, and therefore, the torque necessary to be applied to the square shaft to rotate the bottle proper must be relatively large, because the rotational moment necessary to rotate the bottle proper equals "applied force×distance from rotational axis". Therefore, the square shaft, or the driving force transmitting portion in accordance with the prior art, is subjected to a relatively large amount of rotational force. As a result, the square shaft sometimes becomes permanently twisted, causing thereby the sealing member to be improperly sealed.

In comparison, in the case of the structural arrangement in this embodiment, in which the contact point(s) between the driving force transmitting portion(s) and the driving force receiving portion(s) 1*b* is a substantial distance away, in terms of the radius direction of the developer supply container 1, from the rotational axis of the sealing member 2, it requires a relatively small amount of torque to rotate the developer supply container 1. Moreover, making the driving force transmitting portion(s) contact the driving force receiving portion(s) at a point substantially away from the axial line of the sealing member 2 makes it possible to provide the sealing member 2 with two or more driving force transmitting portions. Therefore, their synergistic effects make it easier to transmit driving force.

Figure 15:
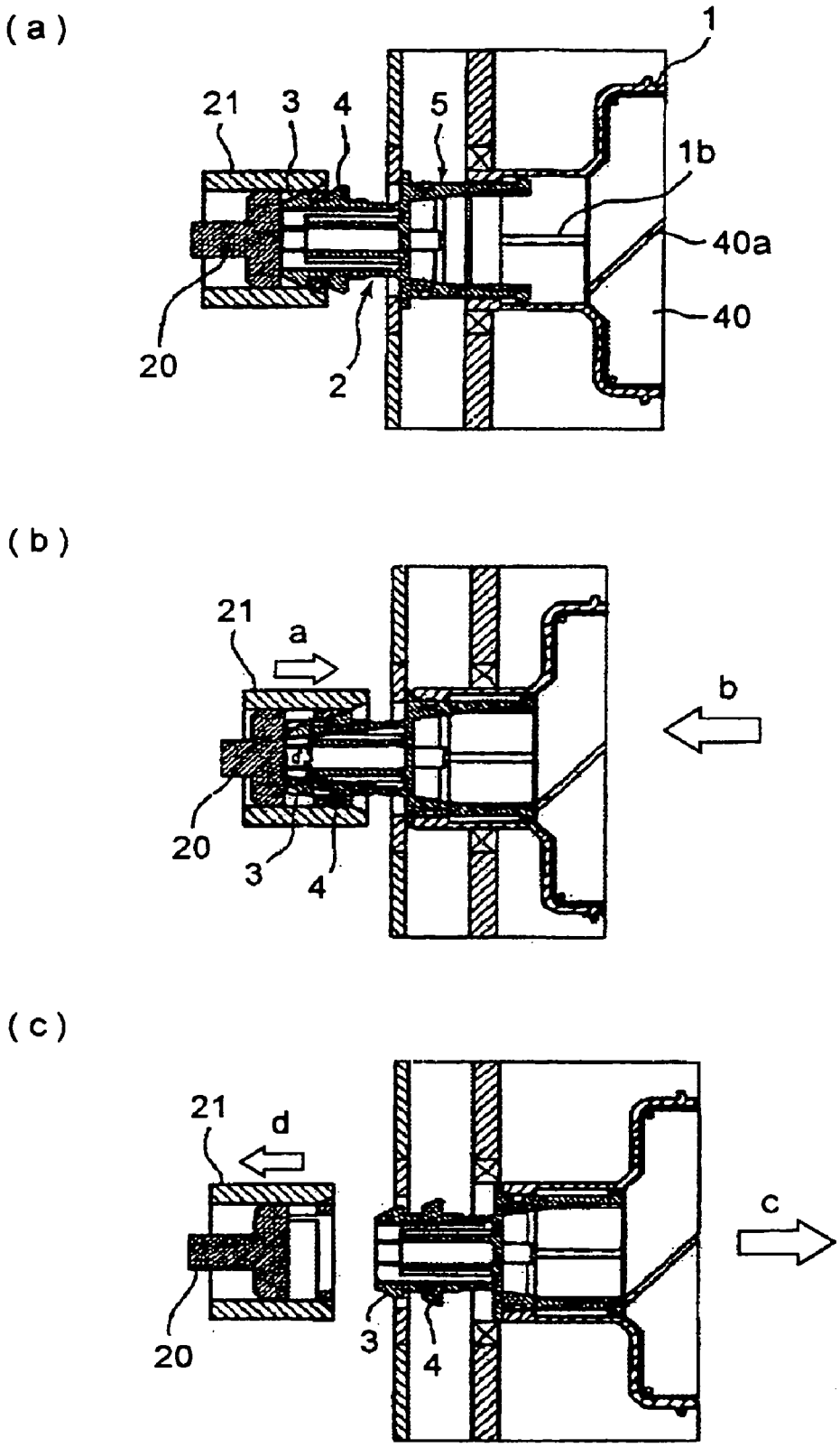
FIG. 15 is a sectional view of the driving portion of the main assembly of the image forming apparatus, and the sealing member of the developer supply container, showing how the two components are disengaged from each other.

Further, the driving force transmitting means in accordance with the prior art, in which driving force is transmitted with the use of the combination of the square hole and square shaft, suffers from the problem that, should the square shaft become permanently twisted even slightly due to the weight of the bottle proper itself as shown in FIG. 15, it becomes difficult for the sealing member 2 to perform its sealing function. In the case of the sealing member 2 in this embodiment, however, even after the driving force transmitting portion(s) 5 of the sealing member 2 has bee permanently deformed by the torque applied thereto, the driving force transmitting portion(s) 5 can flex inward of the outlet portion 1*a*, in terms of the radial direction of the outlet portion 1*a*, minimizing thereby the increase in the friction between the driving force transmitting portion(s) 5 and the outlet 1*a*. Therefore, it does not become difficult for the sealing member 2 to seal the outlet 1*a*; the sealing member 2 is allowed to smoothly seal or unseal the outlet 1*a*.

The above described structural arrangement for the sealing member 2 is highly effective for accomplishing the object of transmitting as much rotational force as possible within the extremely small space, that is, the space afforded by the combination of the sealing member 2 and outlet 1*a*, in particular, when it is necessary to rotationally drive a developer supply container (1) which is heavy and large in capacity, because not only does the above described structural arrangement for the sealing member 2 make it possible to assure that the driving force is satisfactorily transmitted to the developer supply container 1, but also to reduce the size of the driving mechanism of the apparatus main assembly.

The width b and thickness t of the driving force transmitting portion 5 have only to be set to values sufficient for enabling the driving force transmitting portion 5 to withstand the torque necessary to rotate the developer supply container 1. However, if they are larger than certain values, it is possible that the developer flow (discharge) through the outlet 1*a* into the image forming apparatus main assembly will be interfered with by the driving force transmitting portion 5. Therefore, the size of the driving force transmitting portion 5 is desired to be as small as possible within the range in which it can satisfactorily transmit driving force. Thus, in this embodiment, the driving force transmitting portion 5 is given such a curvature that matches the curvature of the internal surface of the developer delivery port 1B, and also, is structured so that not only will there be a certain amount of play between the driving force transmitting portion 5 and the driving force transmitting rib 20*a* of the driving portion 20, but also, the driving force transmitting portion 5 will move along the internal surface of the developer delivery port 1B. Incidentally, the driving force transmitting portion 5 is structured so that during the sealing or unsealing of the developer delivery port 1B, the driving force transmitting portion 5 will not come into contact with (will not slide on) the internal surface of the developer delivery port 1B, except for the driving force receiving portion 1*b* on the internal surface of the developer delivery port 1B.

Further, the driving force transmitting portion 5 in this embodiment is structured to project inward of the outlet 1*a* of the developer delivery port 1B. Therefore as the sealing member 2 is slidingly moved to unseal the outlet 1*a*, it plays the role of loosening the compacted developer in the developer delivery port 1B, in addition to the above described roles.

As will be evident from the above description, the outlet 1*a* is the portion of the container proper 1A, through which the developer in the container proper 1A is discharged, being therefore most likely to be soiled. From the standpoint of minimizing the soiling, therefore, the diameter of the outlet 1*a* is desired to be as small as possible. However, the smaller the diameter of the outlet 1*a*, the more likely to occur the so-called blocking, that is, the phenomenon that the developer becomes compacted in the outlet 1*a* due to the vibrations or the like which occur during the shipment, or the like, of the developer supply container 1, making it sometimes impossible for the developer to be easily discharged (supplied) even after the outlet 1*a* is unsealed.

In this embodiment, however, the driving force transmitting portion 5 is structured to project inward of the outlet 1*a*. Therefore, as the sealing member 2 is slidingly moved in the direction to unseal the outlet 1*a* as described before, the developer, which is blocking the outlet 1*a*, is loosened by this sliding movement of the driving force transmitting portion 5, allowing therefore the developer in the developer supply container 1 to be smoothly discharged.

Figure 12:
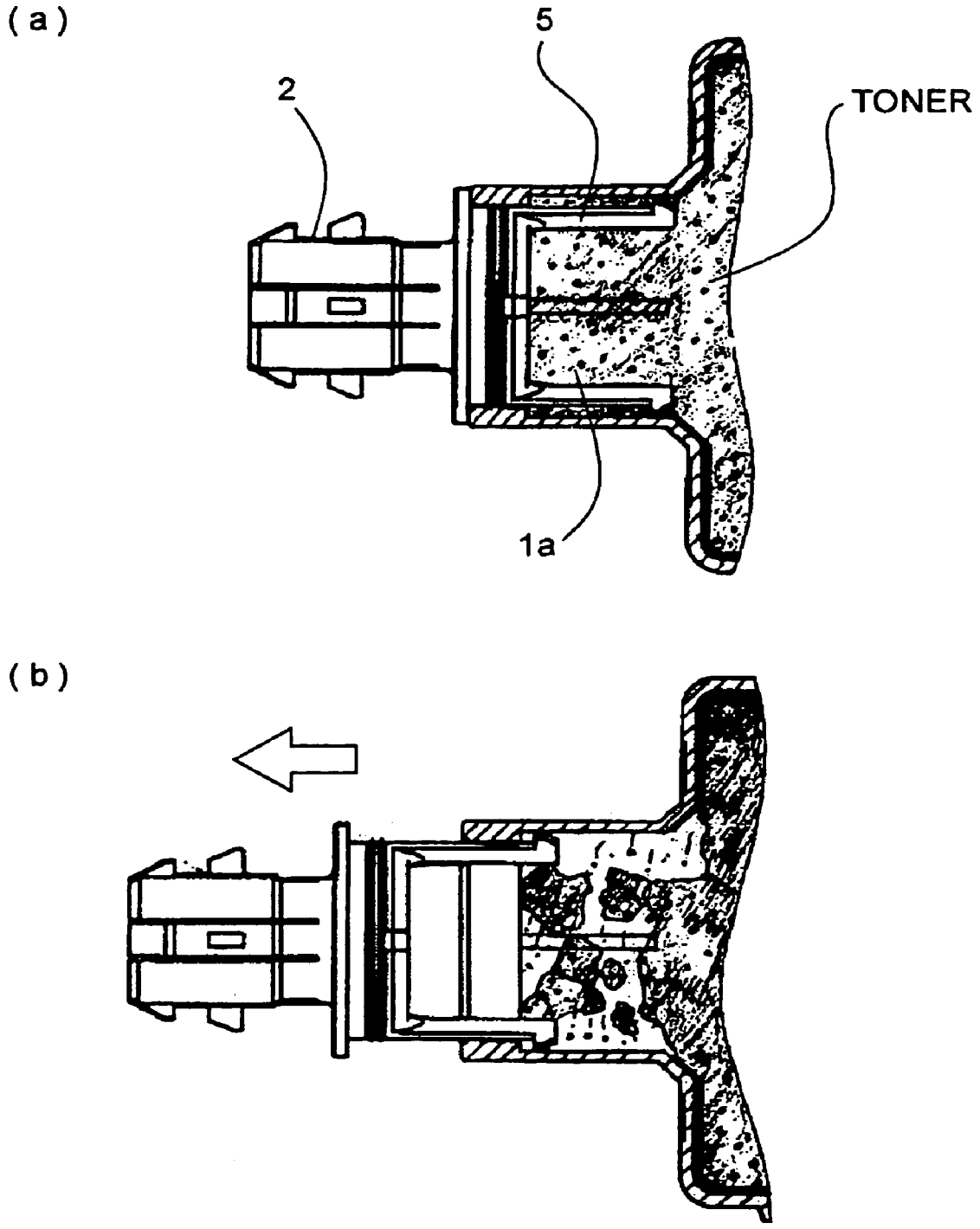
FIG. 12 is a sectional view of the sealing member, and its adjacencies, of the developer supply container, showing how the body of toner, which is blocking the toner outlet, is loosened by the sliding movement of the sealing member.

FIG. 12 shows how the developer compacted in the outlet 1*a* is loosened. FIG. 12(*a*) shows the outlet 1*a* sealed with the sealing member 2, and FIG. 12(*b*) shows the outlet 1*a* after the sealing member has been moved in the direction to unseal the outlet 1*a*. As the container proper 1A of the developer supply container 1 is moved, the sealing member 2, locked in place, in terms of the axial direction of the developer supply container 1, by the driving portion 20, is slidingly moved relative to the outlet 1*a*, unsealing thereby the outlet 1*a*, while loosening the developer compacted in the outlet 1*a* (and therefore blocking outlet 1*a*) by its driving force transmitting portion(s) 5. Therefore, the developer in the developer supply container 1 is smoothly discharged as soon as the outlet 1*a* is unsealed.

According to the present invention, the driving portion 20 and sealing member 2 are structured so that as the sealing member 2 is rotated by the driving portion 20, the driving force transmitting portion(s) 5 of the sealing member 2 comes into contact with the driving force receiving portion(s) 1*b* in the outlet 1*a*, and transmits driving force to the driving force receiving portion(s) 1*b*. Therefore, it is assured that should the developer become compacted in the outlet 1*a* (blocking thereby outlet 1*a*) so firmly that the mere sliding movement of the sealing member 2 is not enough to loosen the compacted developer, the impact caused by the contact between the driving force transmitting portion(s) 5 and the driving force receiving portion(s) 1*b* will loosen the developer which is blocking the outlet 1*a*.

Figure 13:
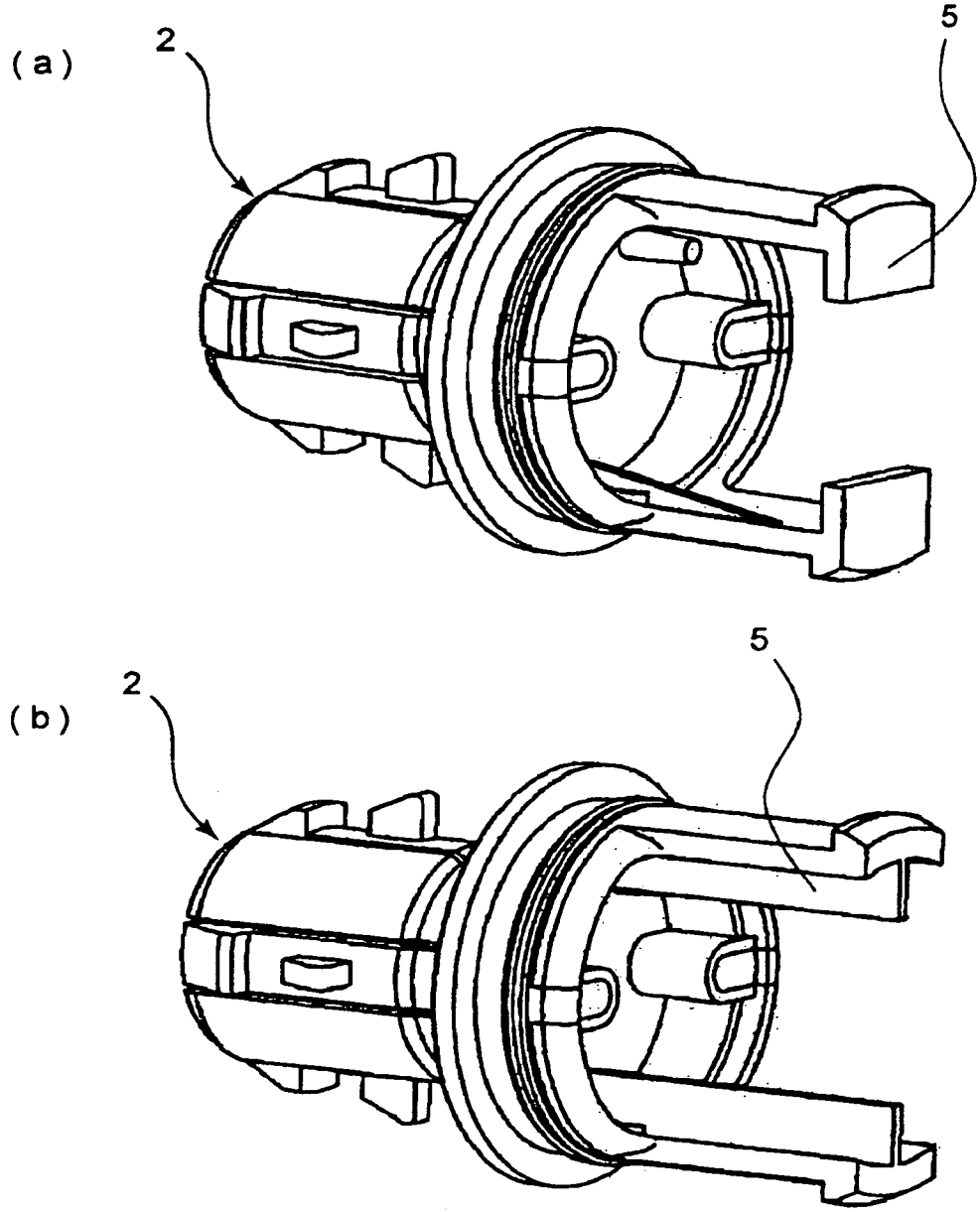
FIG. 13 is a perspective view of the modified version of the driving force transmitting portion of the sealing member in the first embodiment.

Moreover, the possibility of the occurrence of the blocking phenomenon can be further reduced by structuring the driving force transmitting portion 5 as shown in FIGS. 13(*a*) and 13(*b*).

With the driving force transmitting portion 5 being structured as shown in FIG. 13(*a*), the area in which the compacted toner can be loosened by the sliding movement of the sealing member 2 is wider, whereas, with the driving force transmitting portion 5 being structured as shown in FIG. 13(*b*), the area in which the toner is stirred as the sealing member 2 is rotated is wider.

Further, structuring the sealing member 2 so that its driving force transmitting portion(s) 5 projects inward of the outlet 1*a* leads to the reduction of the sizes of the developer supply container 1 and developer supplying apparatus. The reason why it is desired that the driving force is transmitted within the outlet 1*a* as in this embodiment, is as follows. For example, one of the possible methods which come to mind when thinking of transmitting driving force to the developer supply container 1, outside the outlet 1*a*, is to structure the outlet portion 1*a* in two layers, that is, to provide the outlet portion 1*a* with an internal cylinder and an external cylinder, and place the driving force receiving rib(b) therein to transmit driving force. However, such a structural arrangement makes the diameter of the outlet portion 1*a* larger by the amount proportional to the diameter of the external cylinder, making it necessary to enlarge the sealing members 26*a* and 26*b* of the developer supplying apparatus for sealing the outlet portion 1*a*; in other words, such a structural arrangement may make it impossible to design a compact developer supply container 1 and a compact developer supplying apparatus.

However, the developer supply container 1 and developer supplying apparatus can be reduced in size and cost by placing the driving force transmitting portion(s) 5 inside the outlet 1*a* as they are in this embodiment.

Further, as the sealing member 2 is slidingly moved to reseal the outlet 1*a*, the surface of the driving force transmitting portion 5 soiled with developer due to developer replenishment is automatically retracted into the container proper. Thus, the soiled surface does not remain exposed, eliminating therefore the problem that an operator is soiled with developer when replacing the developer supply container 1. In other words, the present invention can provide a developer supply container superior in usability.

Incidentally, as long as the above described effects can be realized, the number, positioning, and configuration of the driving force transmitting portions 5 may be different from those shown in the appended drawings. In other words, the sealing member may be provided with multiple driving force transmitting portions, for example, three, four, etc., or only one. They may be chosen as seen fit.

Further, in order to make the developer supplying operation more reliable, the driving force transmitting portion(s) 5 may be provided with a rib 5*b*, which will be described next.

The driving force transmitting portion(s) 5 in this embodiment is provided with a rib 5*b*, which is located at the tip of the driving force transmitting portion 5, projecting in the radial direction of the sealing member 2. The rib 5*b* plays the role of regulating the distance, by which the sealing member 2 is slidingly moved outward of the outlet 1*a* of the developer supply container 1, by engaging with the riser portion of the aforementioned stepped portion 1*g* of the internal surface of the outlet 1*a*.

The rib 5*b* is provided with a surface 5*a* and a surface 5*b*. The surface 5*a* is the surface by which the rib 5*b* (driving force transmitting portion 5)engages with the driving force receiving portion 1*b* of the container proper 1*b* of the developer supply container 1, and the surface 5*b* is the surface by which the driving force transmitting portion 5 (sealing member 2) engages with the outlet 1*a* to assure that the distance by which the sealing member 2 is slidingly moved outward of the outlet 1*a* will not exceed a predetermined value. Incidentally, the driving force transmitting portion 5 is structured to be flexible enough to temporarily bend toward the axial line of the sealing member 2 when the portion of the driving force transmitting portion 5 of the sealing member 2, having the rib 5*b*, is inserted into the developer supply container 1, but, snap back into the normal state as soon as the portion having the rib 5*b* completely enters the outlet 1*a*.

Further, the internal surface of the outlet 1*a* is provided with the step 1*g* (FIG. 8), the riser portion of which the engages with the projection 5*b*. With the presence of this step 1*g*, should the sealing member 2 slidingly move outward of the outlet 1*a* for some reason, the rib 5*b* of the driving force transmitting portion 5 is caught by the step 1*g*, preventing thereby the sealing member 2 from coming completely out of the outlet 1*a*. In addition, the driving force transmitting portion 5 is made flexible enough for snap-fitting. In other words, the driving force transmitting portion 5 is structured so that when the sealing member 2 is inserted into the outlet 1*a*, the driving force transmitting portion 5 flexibly bends toward the axial line of the sealing member 2 to allow the driving force transmitting portion 5 to smoothly enter the outlet 1*a*, and also, so that once the driving force transmitting portion 5 completely enters the outlet 1*a*, it becomes very difficult for the driving force transmitting portion 5 to slip out of the outlet 1*a*.

What is significant here is that the driving force transmitting portion 5 having the rib 5*b* at its tip is structured to be flexible enough to be snap-fitted into the outlet 1*a*. The advantage of structuring the driving force transmitting portion 5 so that the driving force transmitting portion 5 can be snap-fitted into the outlet 1*a* is that the movement of the sealing member 2 outward of the outlet 1*a*, in terms of the thrust direction (axial direction) of the sealing member 2, can be assuredly controlled, simply providing the internal surface of the outlet 1*a* with the step 1*g*, which is very small. In other words, structuring the driving force transmitting portion 5 so that the driving force transmitting portion 5 can be snap-fitted into the outlet 1*a*, makes it feasible to form the step 1*g* even as an integral part of the outlet 1*a* of the developer supply container 1, the wall of which is relatively thin, being therefore capable of providing only a very small step (1*g*).

Further, the driving force transmitting portion 5 and outlet 1*a* may be structured so that the surface of the rib 5*b* and the riser portion of the step 1*g* of the outlet 1*a*, which engage with each other, may be tilted as shown in the appended drawings to further assure that the sealing member 2 will not slip out of the outlet 1*a*.

With the provision of the rib 5*b* structured as described above, even if a user is rather rough when supplying the apparatus main assembly 100 with developer, the problem that driving force cannot be transmitted because the sealing member 2 slipped out of the outlet 1*a* does not occur. In other words, providing the driving force transmitting portion 5 of the sealing member 2 of the developer supply container 1 with the above described rib 5*b* assures that developer is smoothly supplied from the developer supply container 1 into the apparatus main assembly 100.

The sealing member 2 described above is desired to be formed of resinous substance such as plastic, by injection molding. However, the material and manufacturing method for the sealing member 2 is optional. Further, the sealing member 2 may be formed in a single piece, or in multiple pieces which will be bonded together. Further, not only is the sealing member 2 required to function as a coupler for transmitting driving force, but also to seal the outlet 1*a* by being pressed into the outlet 1*a*. Therefore, it is required to have proper levels of strength and elasticity.

As the substance capable of satisfying such requirements, low density polyethylene, polypropylene, linear polyamide, Nylon (commercial name), high density polyethylene, polyester, ABS, HIPS (highly impact resistant polystyrene), etc., are preferable.

It is obviously possible to use two-color injection molding in order to form only the seal portion of the sealing member, of relatively soft substance such as elastomer, while forming the main structure of the sealing member, of the resinous material such as those described above. This manufacturing method is preferable because it forms the actual seal portion of the sealing member, of such a soft substance as elastomer, making it possible to produce a sealing member, which is superior in sealing ability, and yet, is low in the amount of force required to slidingly move the sealing member to unseal the outlet 1*a*. In this embodiment, the main structure of the sealing member 2 is formed of ABS resin, and only the actual sealing portions of the sealing member 2 are formed of elastomer, using two-color injection molding.

Next, referring to FIG. 14, how the driving portion 20 and sealing member 2 in this embodiment are engaged with each other will be described. FIG. 14(*a*) depicts the step in which a new developer supply container 1 is inserted by a user into the apparatus main assembly 100 in the arrow a direction, to be set in the apparatus main assembly 100, that is, the step before the developer supply container 1 is engaged with the driving portion 20 in the apparatus main assembly 100.

Figure 14:
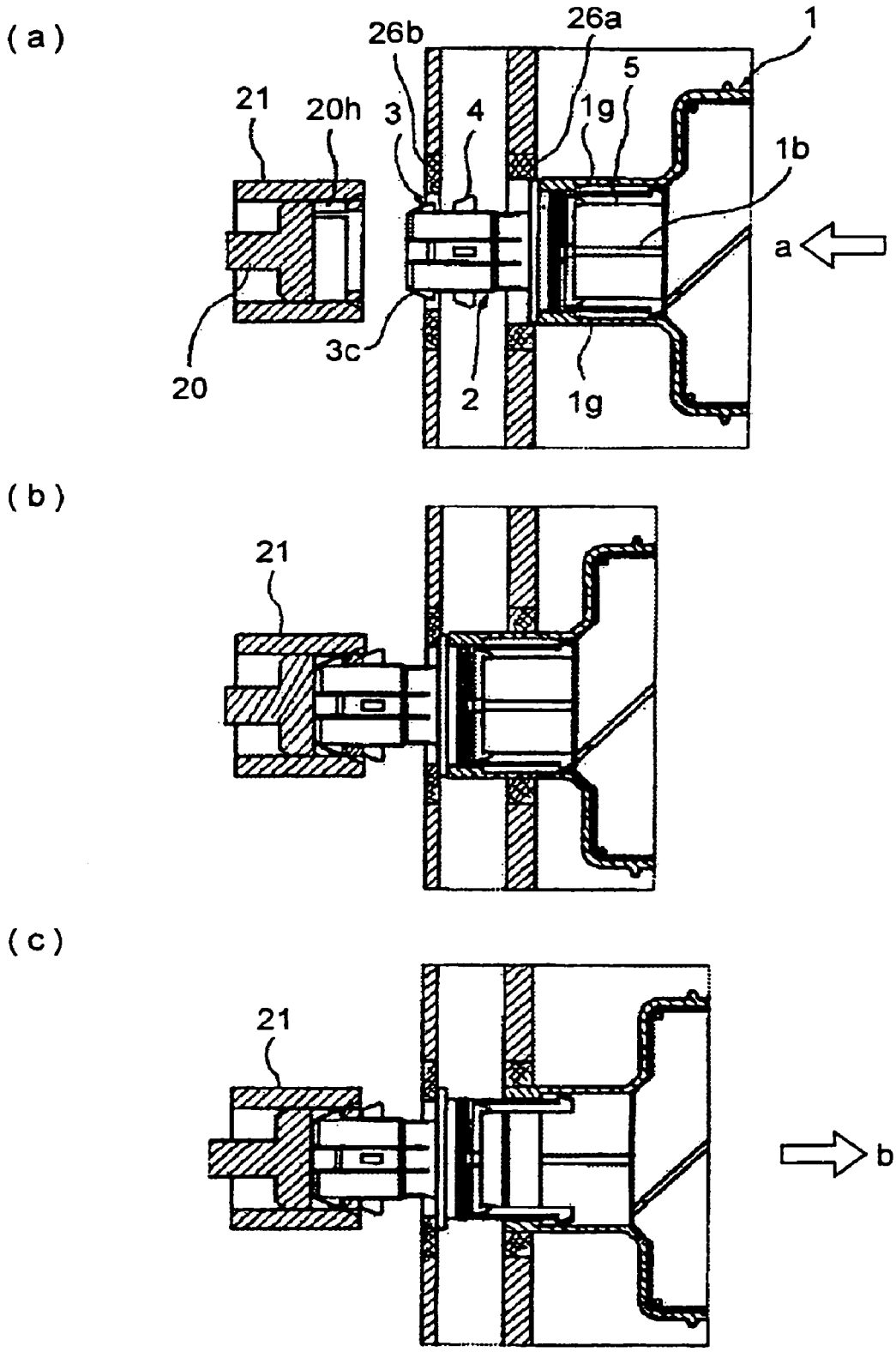
FIG. 14 is a sectional view of the driving portion of the main assembly of the image forming apparatus, and the sealing member of the developer supply container, showing how the two components are engaged with each other.

As the developer supply container 1 is inserted further into the apparatus main assembly 100 from the position shown in FIG. 14(*a*), the diagonal surface 3*c* of the locking projection 3 of the sealing member 2 comes into contact with the driving portion 20, and then, the locking projection 3 is gradually depressed toward the axial line of the sealing member 2, with the portion of the sealing member 2 having the locking projection 3 being flexibly bent toward the axial line, as shown in FIG. 14(*b*).

Next, referring to FIG. 14(*c*), as the developer supply container 1 is further inserted, the contact point between the sealing member 2 and driving portion 20, which was on the diagonal surface 3*c*, gradually shifts upward onto the straight top surface of the locking projection 3, and moves across the straight top surface. Then, the moment the contact point moves beyond the rearward end of the straight surface, the contact between the locking projection 3 and driving portion 20 vanishes, allowing the locking projection 3*c* to fit into the sealing member locking hole 20*h* of the driving portion 20, which is between the ribs 20*a* (FIG. 11) of the driving portion 20, in terms of the circumferential direction of the driving portion 20. As the result, the flexible portion of the sealing member 2 having the locking projection 3*c* is allowed to snap back into the normal state, locking thereby the locking projection 3 (sealing member 2) with the driving portion 20. In this state, the locking projection 3 is firmly locked with the driving portion 20, virtually locking thereby in position the sealing member 2 relative to the apparatus main assembly 100 in terms of the thrust direction (axial direction).

Thus, when the developer supply container 1 is later pulled backward, that is, in the arrow b direction, as shown in FIG. 14(*c*), the sealing member 2 remains firmly attached to the driving portion 20; it is not retracted with the developer supply container 1 in the arrow b direction. Since only the container proper 1A of developer supply container 1 is retracted, the sealing member 2 is moved outward of the developer supply container 1, in relative terms, unsealing the outlet 1*a*. Incidentally, the mechanism for slidingly moving the developer supply container 1 in the insertion or retraction direction may be mechanically tied to the mechanism for moving the developer supply container replacement front cover 15 of the apparatus main assembly 100 in the opening or closing direction.

The mechanism for slidingly moving the sealing member 2 relative to the developer supply container 1 may be structured so that the developer supply container 1 is slidingly moved while the sealing member 2 is kept locked in place, or on the contrary, the sealing member 2 is slidingly moved while the developer supply container 1 is kept locked in place. Further, it may be structured so that both the sealing member 2 and developer supply container 1 are slidingly moved relative to each other. As for the removal of the developer supply container 1 in the apparatus main assembly 100 for the replacement thereof with a brand-new developer supply container 1, all that is necessary to do is to carry out in reverse the above described steps (engaging and unsealing steps) for mounting the developer supply container 1 into the apparatus main assembly 100.

[Method for Disengaging Sealing Member from Driving Portion]

As the developer supply container 1 becomes empty (due to the delivery of the developer therefrom), the empty developer supply container 1 must be removed, and a new developer supply container 1 must be mounted into the apparatus main assembly 100. In order to remove the empty developer supply container 1, the sealing member 2 thereof must be disengaged from the driving portion 20. Next, referring to FIG. 15, how the sealing member locking projection 3*c* is disengaged from the driving portion 20 of the apparatus main assembly 100 will be described.

FIG. 15(*a*) shows the developer supply container 1, the developer in which has been completely exhausted, and the outlet 1*a* of which is open. As the container replacement front cover 15 is opened when the developer supply container 1 is in the state shown in FIG. 15(*a*), the container proper 1A is slidingly moved by the movement of the front cover 15 in the arrow b direction, causing the sealing member 2 to reseal the outlet 1*a*, and the sealing member disengagement ring 21 to slide in the arrow a direction. As the disengagement ring 21 is slid, the sealing member disengagement projection 4 is depressed toward the axial line of the sealing member 2, flexibly bending the portion of the sealing member 2 having the disengagement projection 4 as well as the engagement projection 3. As the result, the engagement between the driving portion 20 and projection 3 becomes dissolved.

Next, referring to FIG. 15(*c*), as the front cover 5 is further opened, the container proper 1A of the developer supply container 1 is slid by the closing movement of the front cover 5 in the arrow mark c direction, to the location from which a user can easily remove the developer supply container 1.

The apparatus main assembly 100 may be structured so that the movement of the sealing member disengagement ring 21 is tied to the opening or closing movement of the front door of the apparatus main assembly 100 for development supply container replacement; more specifically, the disengagement ring 21 is moved in the arrow a direction, by the opening movement of the front cover 15, disengaging thereby the sealing member 2 from the driving portion 20, whereas as the front cover 15 is closed, the disengagement ring 21 is moved in the arrow b direction. Instead, the disengagement ring 21 may be provided with a driving means, such as a motor, independent from the means for moving the front door 15, so that it can be moved independently from the front door 15. Further, the disengagement ring 21 may be provided with a manual lever, the movement of which is independent from that of the front door 15, in order to make it possible for the ring 21 to be moved independently from the developer supply container replacement front door 15 of the apparatus main assembly 100. In other words, the method for moving the sealing member disengagement ring 21 is optional.

<Variations of Preceding Embodiment>

Hereinafter, the variations of the first embodiment of the present invention will be described with reference to FIG. 16. The components, members, portions, etc., of the main assembly of the image forming apparatus, and the developer supply container, in the following variations of the first embodiment, which are similar in function as those in the above described first embodiment will be given the same referential symbols as those given in the first embodiment, and will not be described in detail here.

Figure 16:
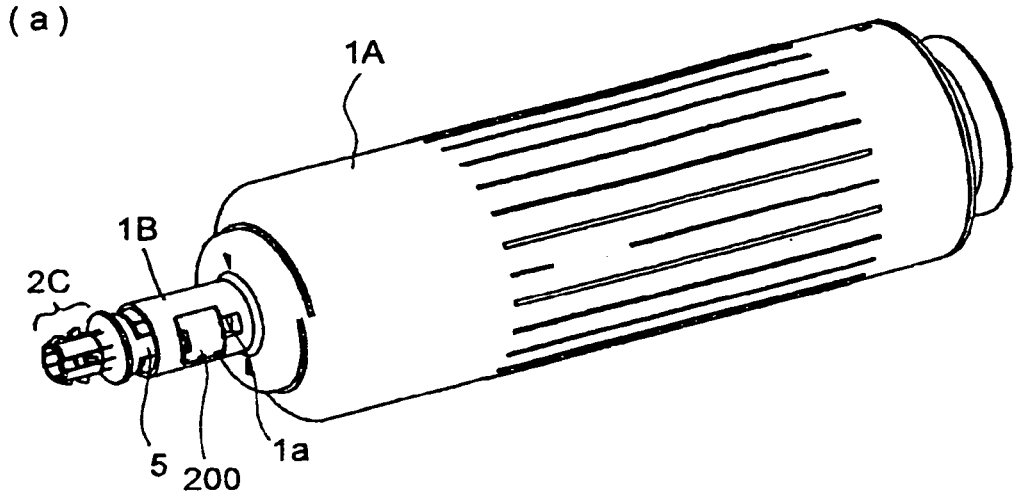
FIG. 16 is a perspective view of the modified version of the developer supply container in the first embodiment, showing the structure thereof.
Figure 16:
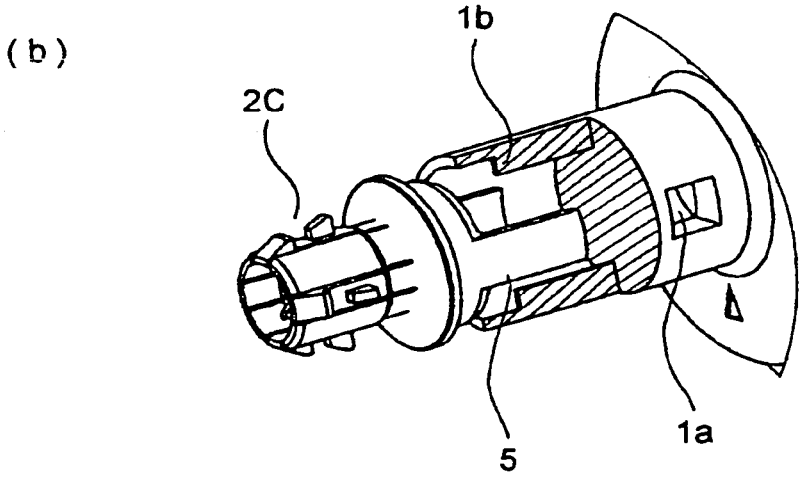

Referring to FIG. 16, in this first variation, the coupler having the driving force transmitting portion(s) 5 is independent from the sealing member. Such a structural arrangement also can provide the same effects as those provided by the structural arrangement in the first embodiment.

Described more concretely, the locking projection of the coupler 2*c* receives rotational driving force by locking with the driving portion 20 of the apparatus main assembly 100, and the received rotational driving force is transmitted to the container proper by the driving force transmitting portion 5. Also in this variation, the driving force transmitting portion 5 and its counterpart, that is, the driving force receiving portion 1*b* of the container proper, are structured so that the driving force transmitting portion 5 is allowed to rotate by a sufficient angle during the period between when the driving force transmitting portion 50 of the driving portion 20 of the apparatus main assembly 100 begins to be rotated and when the driving force transmitting portion 50 comes into contact with the driving force receiving portion 1*b*.

Incidentally, in this embodiment, the outlet 1*a* through which the developer is discharged is provided with a shutter 200, which opens or shuts the outlet 1*a*. The shutter 200 is independent from the driving force transmitting portion 5, and the outlet 1*a* is opened or shut as necessary when the apparatus is in use.

In other words, the driving force transmitting portion 5 does not need to be provided as an integral part of the sealing member as it is in the first embodiment; the driving force transmitting portion 5 may be independent from the sealing member as it is in this variation.

For the simplification of the developer supply container structure, it is preferable that the driving force transmitting portion 5 is provided as an integral part of the sealing member.

Next, another variation of the first embodiments will be described.

In the above described embodiments of the present invention, the coupler portion of the sealing member is structured to be flexible so that it snap-fits with the driving portion of the apparatus main assembly. However, the structure of the coupler portion of the sealing member does not need to be limited to this structure; one of the known coupling mechanisms may be employed. For example, the sealing member may be provided with a coupling rod having a rib(s), as a coupling-driving portion(s), which radially projects from the coupling rod, and the driving portion of the apparatus main assembly may be provided with a hollow cylindrical member, the internal surface of which has a groove(s) matching the rib(s) of the sealing member.

As for the automatic unsealing or resealing of the developer supply container by the sealing member, in consideration of the reliability in the unsealing and resealing of the outlet of the developer supply container, it is preferable that the sealing member is structured to be flexible so that it snap-fits with the driving portion of the apparatus main assembly as in the first embodiment.

Next, the performance of the toner supply containers in the above described first embodiment, and its variations, of the present invention will be described in detail with reference to the tests carried out to evaluate the toner supply containers.

<Test 1 for Embodiment 1>

The following tests were carried out in consideration of such a situation that a developer supply container is removed from the apparatus main assembly before the container becomes completely empty.

Figure 6:
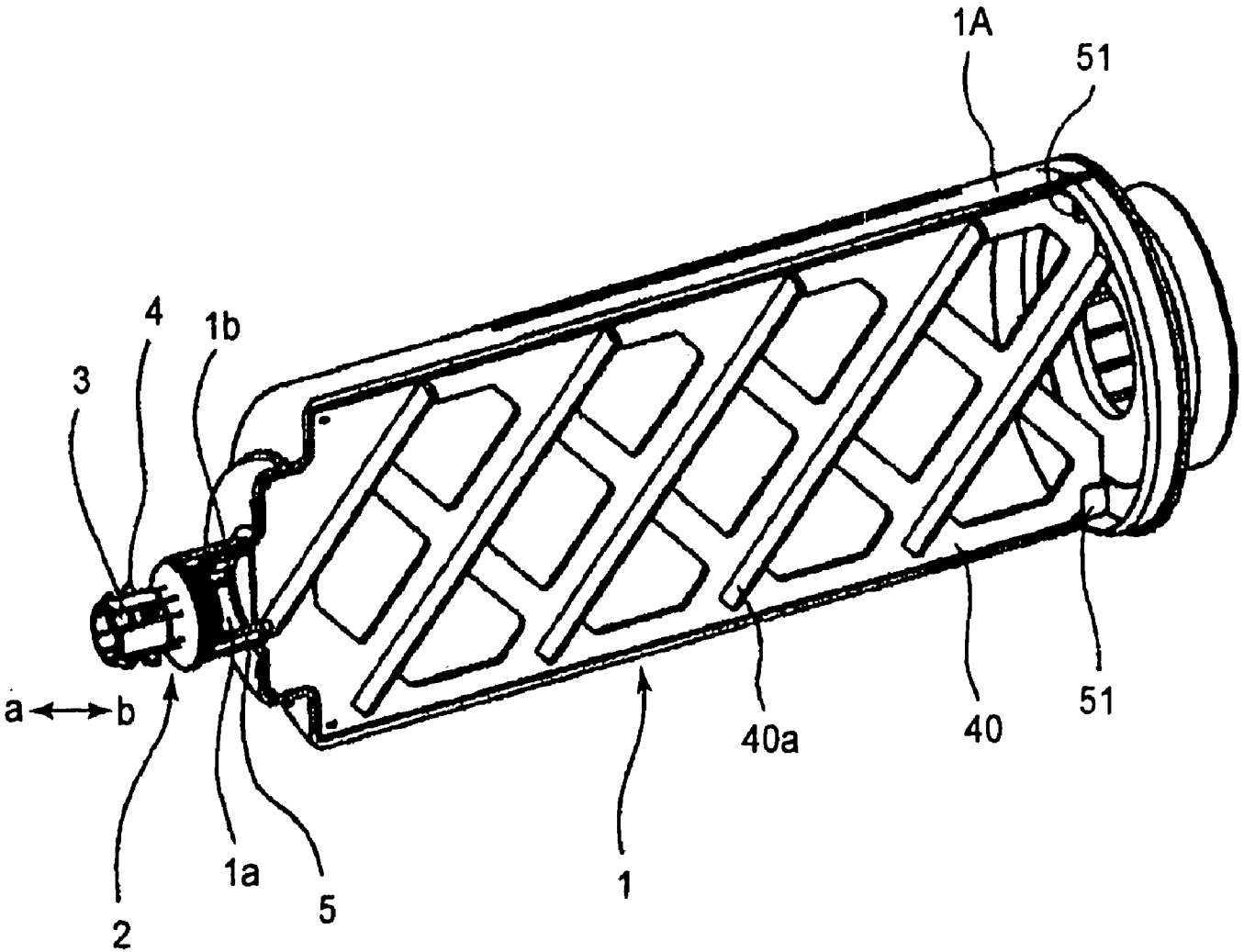
FIG. 6 is a sectional view of the driving portion of the main assembly of the image forming apparatus and the sealing member, and its adjacencies, of the developer supply container which has an internal baffling member.
Figure 7:
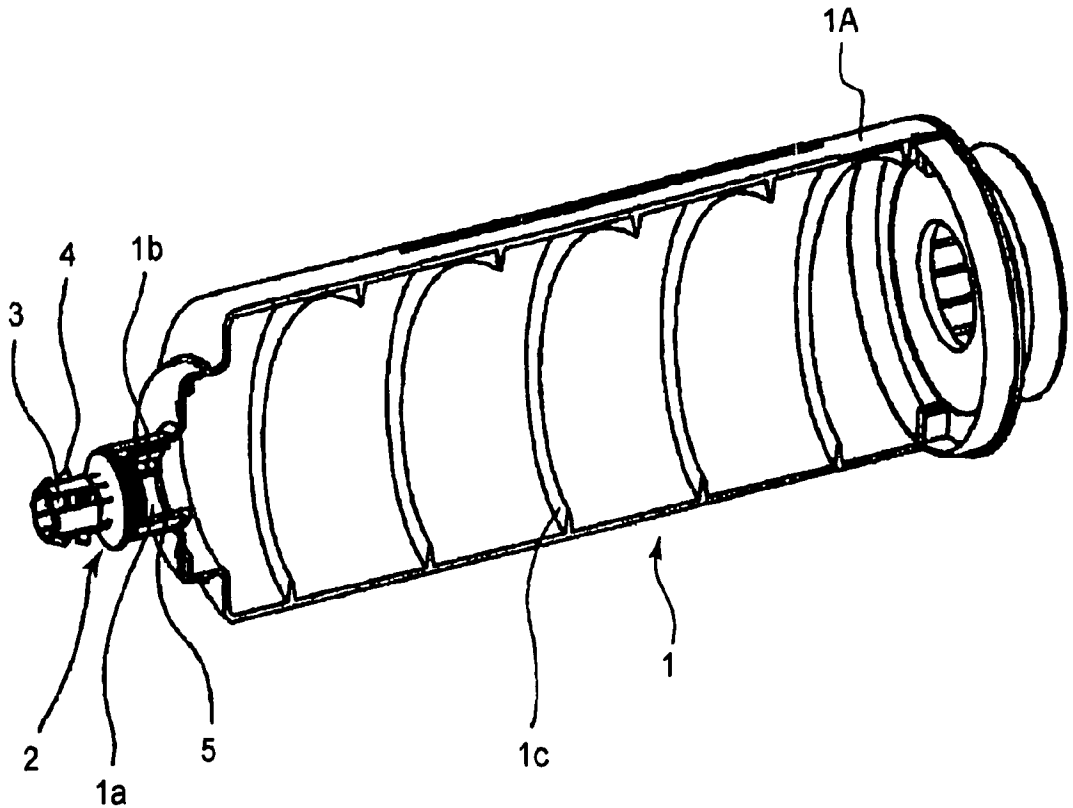
FIG. 7 is a sectional perspective view of a developer supply container having internal spiral ribs.

The developer supply container 1 in the first embodiment of the present invention, shown in FIG. 6, was filled with 2,000 g of toner, and then, was set in the image forming apparatus main assembly. Then, the container proper 1A of the developer supply container 1 was rotationally driven at a predetermined revolution (30 rpm) to discharge the toner therefrom.

The toner was intermittently discharged; the developer supply container 1 was rotated twice for two seconds, with the interval of one second. Then, the amount of the force required for the sealing member to reseal the container proper 1A was measured (force necessary to insert the sealing member 2 into the outlet 1*a* was measured) when the developer supply container 1 was removed from the apparatus main assembly 100.

The amount of the force necessary for resealing the developer supply container 1 was 13.72 N (1.4 kgf).

<Test 1 for Comparitive Example>

Figure 17:
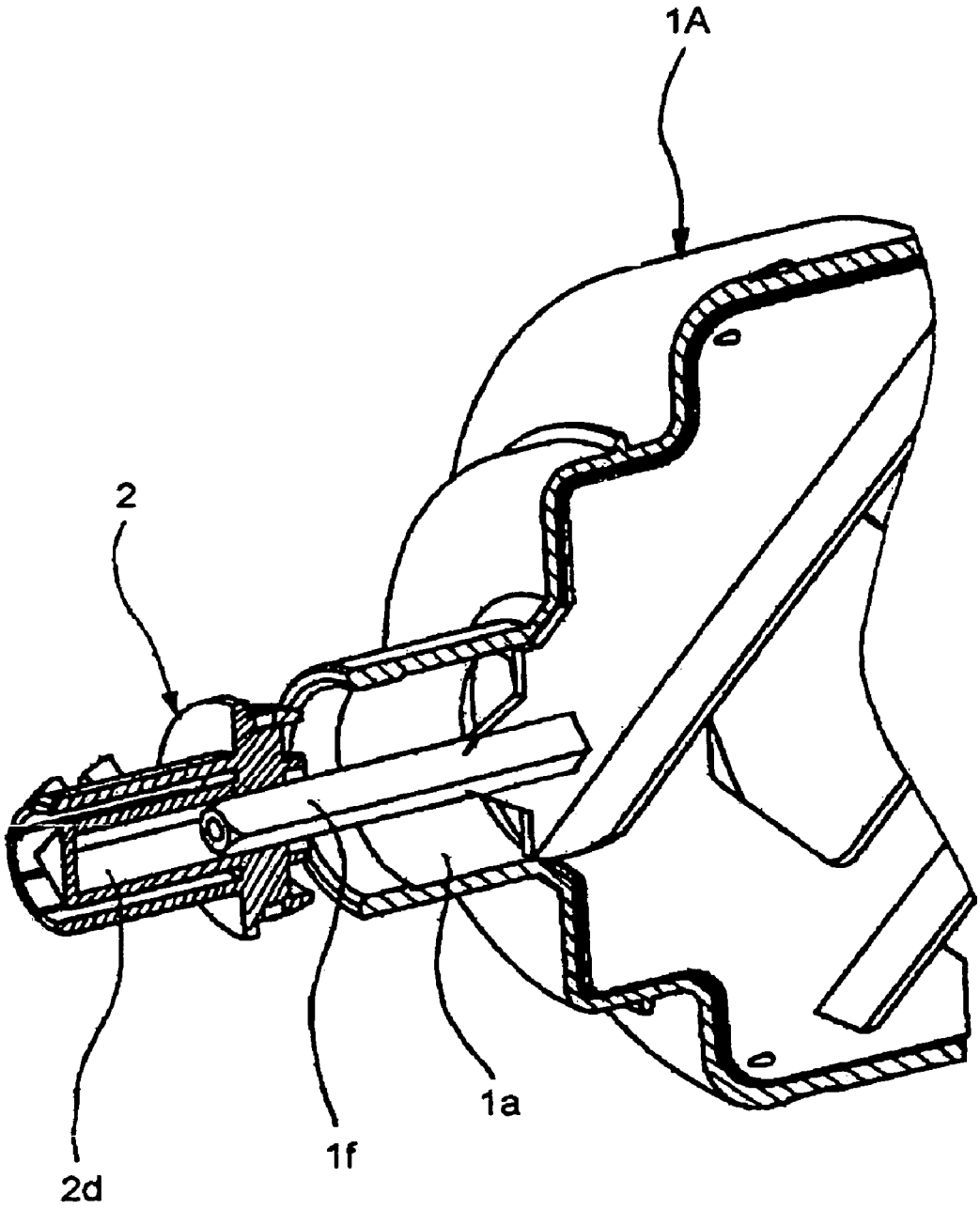
FIG. 17 is a perspective view of a developer supply container in accordance with the prior art, showing the structure thereof.

The developer supply container in accordance with the prior art (patent document No. 1) shown in FIGS. 16 and 17 was filled with toner as was the developer supply container in the first embodiment, and then, was rotationally driven under the same condition as that of the preceding test. Then, the amount of the force necessary to reseal the container proper 1A with the sealing member 2 was measured.

The force necessary for resealing the container proper 1A with the sealing member 2 was 71.5 N (7.3 kgf).

The comparison between the results from the above described two tests revealed that the developer supply container 1 in the first embodiment was smoothly re-sealable with the sealing member 2 even when the sealing member 2 was under torque, for example, immediately after the developer supply container 1 was removed from the apparatus main assembly 100 before it became empty; the developer supply container 1 in the first embodiment could be removed, with no problem, even before it became empty.

In comparison, the developer supply container 1 in accordance with the prior art could not be easily resealed with the sealing member 2. Thus, in order to remove the developer supply container 1 from the apparatus main assembly, a substantial amount of force had to apply to the front cover to open it. Moreover, the outlet 1*a* of the removed developer supply container 1 was not completely sealed with the sealing member 2, allowing therefore the developer to leak through the gap between the outlet 1*a* and the sealing member 2.

<Test 2 for Developer Supply Container in First Embodiment>

Next, the following tests were carried out in order to compare the developer supply container in accordance with the present invention with the developer supply container in accordance with the prior art, in terms of the level of easiness at which developer can be discharged therefrom after their outlets have been blocked with the developer.

The developer supply container 1 in the first embodiment of the present invention, shown in FIG. 6, was filled with 2,000 g of toner, as was in the first of Tests 1, and this container was vertically positioned, with the outlet 1*a* facing downward. Then, it was left unattended for 40 days in the high temperature-high humidity environment, in which the temperature and relative humidity were 40° C. and 90%, respectively.

After being kept unattended for 40 days in the high temperature-high humidity environment, it was reasonable to presume that the toner in the developer supply container 1 had absorbed a substantial amount of humidity, being therefore very low in fluidity.

It was also reasonable to assume that the toner in the outlet 1*a* had become highly compacted due to the gravity, since the developer supply container 1 was vertically positioned with the outlet 1*a* facing downward.

After leaving the developer supply container 1 unattended in the above described severe environment, the developer supply container 1 was gently set in the image forming apparatus main assembly, that is, set without being shaken, and then, the container proper 1A of the developer supply container 1 was rotationally driven at a predetermined revolution (30 rpm) to discharge the toner therefrom. The toner began to be smoothly discharged (supplied) at a desired rate, as soon as the container proper 1A began to be rotated.

<Test 2 for Conventional Developer Supply Container>

The developer supply container in accordance with the prior art (patent document No. 1) shown in FIGS. 16 and 17 was filled with toner as was in Test 2 for the developer supply container in the first embodiment, and then, was rotationally driven under the same condition as that of the preceding test. The toner was not discharged at all for the first 200 seconds or so, and then, the toner in the outlet 1*a* began to loosen. Then, the toner began to be properly discharged after 230 seconds or so after the developer supply container 1 began to be rotated.

The following was obvious from the comparison between the two Tests 2. That is, in the case of the sealing member 2 in the first embodiment, that is, the sealing member 2 having the driving force transmitting member(s) 5, as soon as it was slidingly moved, the toner having been compacted in the outlet 1*a* was loosened; in other words, the blockage of the outlet 1*a* caused by the compacted toner was immediately dissolved. Therefore, the toner was smoothly discharged, with no problem, from the very beginning of the toner discharge step.

In comparison, in the case of the conventional developer supply container 1, virtually no toner was discharged for the first 200 seconds or so. In other words, for the first 200 seconds or so, the toner in the developer supply container 1 remained compacted. Then, after roughly 230 seconds since the beginning of the rotation of the container proper 1A, the toner began to loosen and be discharged.

Test 2 for the developer supply container 1 in the first embodiment proves that in the case of the developer supply container 1 in the first embodiment, even if the toner in the developer supply container 1 bridges due to the severe condition of the environment in which the developer supply container 1 is left unattended, the toner can be discharged at a proper rate from the beginning of the toner discharging step (as soon as container proper of developer supply container begins to be rotated).

As described above, according to the present invention, the following effects can be realized.

Even if there are errors in the measurements and assemblages of the components of a developer supply container, and the components related thereto, rotational driving force can be reliably transmitted from the apparatus main assembly to the developer supply container.

Driving force can be reliably transmitted even to a developer supply container of a relatively large capacity.

A sealing member can be smoothly moved to unseal or reseal a developer supply container, making it possible to provide a developer supply container superior in usability.

Even if the developer delivery port (outlet 1*a*) of a developer supply container becomes blocked with the developer therein, the developer, which is blocking the developer delivery port, is loosened by the sliding movement of the sealing member for unsealing the port, and/or the impacts which occur as the sealing member comes into contact with the container proper of the developer supply container. Therefore, the developer in the developer supply container is smoothly discharged (supplied).

It is possible to provide a developer supply container from which the toner can be properly delivered regardless of the manner in which a user carries out the toner replenishment operation.

All that is necessary to correctly snap-fit a developer supply container in the main assembly of an electrophotographic image forming apparatus is to simply insert the container into the main assembly. Further, when necessary to remove the developer supply container snap-fitted in the main assembly, the container can be easily disengaged from the main assembly, by simply pressing the developer supply container disengagement projection. In other words, the apparatus main assembly can be easily replenished with developer with the use of the developer supply container, simple in structure and easy to operate.

In other words, the present invention makes it possible to provide a developer supply container superior in usability.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container detachably mountable to an image forming apparatus, said container comprising:

a rotatable container body for containing a developer;

a drive coupling member, provided substantially at a rotation center of said developer supply container, and being engageable with a driving member provided in the image forming apparatus, wherein said drive coupling member has a drive transmitting portion for transmitting a rotational force received from said driving member to said container body; and an engaging portion, provided with said container body, and being engageable with said drive transmitting portion to receive the rotational force, wherein said drive transmitting portion is disposed so as to be idly rotatable for a sufficient time after a start of rotation of said drive transmitting portion by the rotational force and before engagement with said engaging portion.

2. A container according to claim 1, wherein said drive transmitting portion is engageable with said engaging portion provided in said container body.

3. A container according to claim 2, wherein said drive transmitting portion is engageable with said engaging portion at a position away from a rotational axis of said developer supply container.

4. A container according to claim 3, wherein a number of said drive transmitting portion is two, said drive transmitting portions are provided at substantially opposed positions, and a number of said engaging portion is two, said engaging portions are provided corresponding to said drive transmitting portions, respectively.

5. A container according to claim 1, wherein said drive coupling member includes a sealing portion for unsealably sealing a developer discharge opening provided with said container body.

6. A container according to claim 5, wherein said container body has a large diameter portion containing the developer, and a small diameter portion containing the developer provided at one end of said large diameter portion, and when said sealing portion is at a position for unsealing the developer discharge opening, a part of said drive transmitting portion is engaged with said engaging portion provided in said small diameter portion.

7. A container according to claim 6, wherein said drive transmitting portion is provided extended along an inner surface of said small diameter portion.

8. A container according to claim 5, wherein said sealing portion is movable between an opening position where it opens the developer discharge opening and a closing position where it closes the developer discharge opening.

9. A container according to claim 8, wherein said drive coupling member is provided with a locking portion for locking engagement with the driving member, and wherein said sealing portion is movable between the opening position and the closing position when said locking portion is in locking engagement with the driving member.

10. A container according to claim 5, wherein said drive transmitting portion is provided with a regulating portion for regulating a distance by which it is spaced away from said container body.

11. A container according to claim 1, wherein said engaging portion is provided with a projecting portion projected from an inner surface of said container body.

12. A container according to claim 1, wherein said drive transmitting portion is provided at each of opposing positions.

13. A container according to claim 1, wherein at least one of said drive transmitting portions is provided in a range of 180°.

14. A container according to claim 1, wherein said drive coupling member is provided with a hook for hooking engagement with a hole provided in the driving member.

15. A developer supply container detachably mountable to an image forming apparatus, said container comprising:

a rotatable container body for containing a developer;

a drive coupling member, provided substantially at a rotation center of said developer supply container, and being engageable with a driving member provided in the image forming apparatus, wherein said drive coupling member includes a drive transmitting portion for transmitting a rotational force received from the driving member to said container body; and an engaging portion provided in said container body, engageable with said drive transmitting portion to receive the rotational force, wherein said drive transmitting portion is engageable with said engaging portion at a position radially away from a rotational axis of said developer supply container.

16. A container according to claim 15, wherein said engaging portion is provided with a projecting portion projected from an inner surface of said container body.

17. A container according to claim 15, wherein said drive transmitting portion is provided at each of opposing positions.

18. A container according to claim 15, wherein at least one of said drive transmitting portions is provided in a range of 180°.

19. A container according to claim 15, wherein said drive coupling member has a sealing portion for unsealably sealing a developer discharge opening provided with said container body.

20. A container according to claim 19, wherein said sealing portion is movable between an opening position where the developer discharge opening is opened and a closing position where the developer discharge opening is closed.

21. A developer supply container detachably mountable to an image forming apparatus, said container comprising:

a rotatable container body for containing a developer, said container body is provided with a developer discharge opening;

a sealing member, provided substantially at a rotation center of said developer supply container, for unsealably sealing the developer discharge opening, wherein said sealing member includes a drive coupling portion engageable with a driving member provided in said image forming apparatus, and a drive transmitting portion for transmitting a rotational force received from the driving member to said container body when said sealing member is at an opening position where the developer discharge opening is opened; and an engaging portion, provided in said container body, engageable with said drive transmitting portion, wherein said drive transmitting portion is disposed so as to be idly rotatable for a sufficient time after start of rotation of said drive transmitting portion by the rotational force and before engagement with said engaging portion, and wherein said sealing member is movable from the opening position to a resealing position where the developer discharge opening is resealed.

* * * * *

UNITED STATES PATENT AND TRADEMARK OFFICE

CERTIFICATE OF CORRECTION

PATENT NO. : 6,993,273 B2
APPLICATION NO. : 10/761316
DATED : January 31, 2006
INVENTOR(S) : Yusuke Yamada It is certified that error appears in the above-identified patent and that said Letters Patent is hereby corrected as shown below:

COLUMN 1:

Line 32, “printers” should read --printer--.

Figure 18:
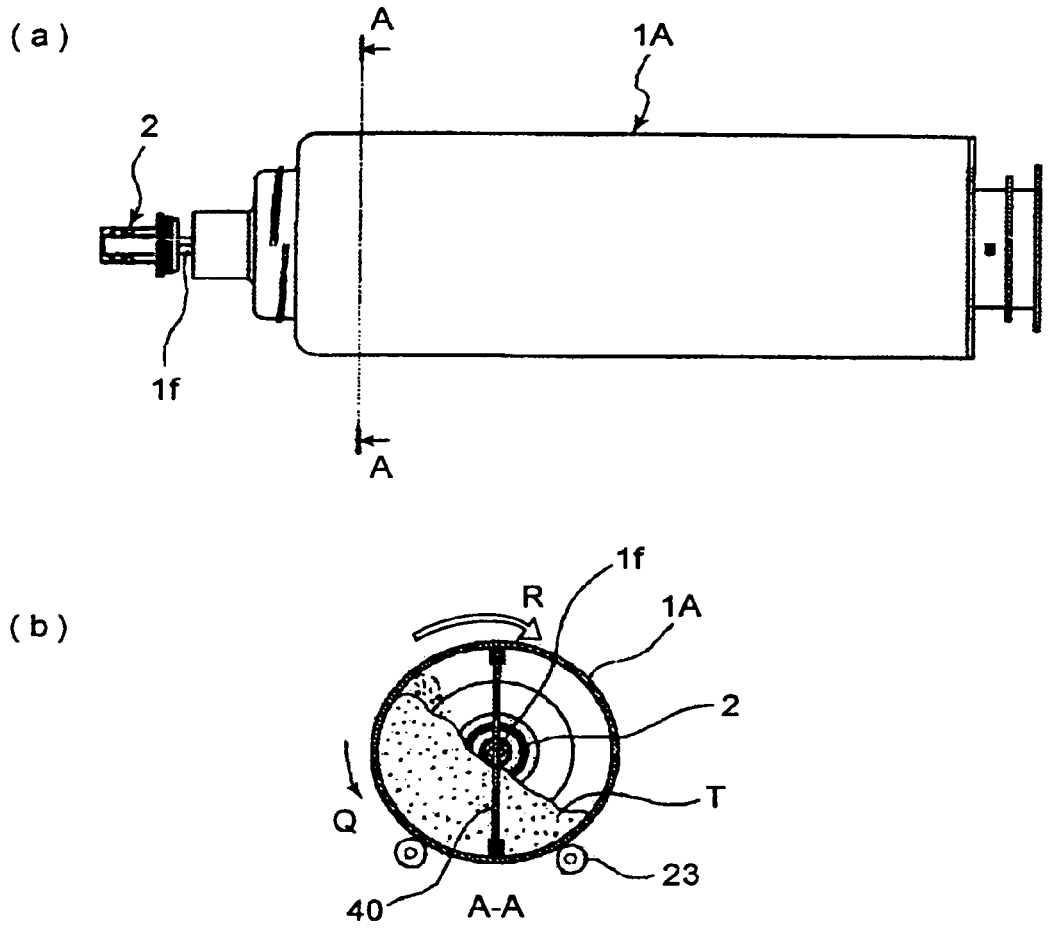
FIG. 18 is a sectional perspective view of the toner bottle in accordance with the prior art, showing the interior thereof.

COLUMN 2:

Line 54, “FIGS. 17 and 18,” should read --FIG. 17 and FIGS. 18(a) and 18(b),--.

COLUMN 4:

Line 24, “FIG. 4 is a” should read --FIGS. 4(a) - 4(c) are--; and “view” should read --views--;
Line 37, “baffling” should read --baffle--;
Line 40, “FIG. 8 is a drawing” should read --FIGS. 8(a) - 8(d) are drawings--;
Line 42, “FIG. 9 is a” should read --FIGS. 9(a) and 9(b) are--; and “view” should read --views--;
Line 45, “FIG. 10 is a drawing” should read --FIGS. 10(a) - 10(e) are drawings--;
Line 52, “FIG. 12 is a” should read --FIGS. 12(a) and 12(b) are--; and “view” should read --views--;
Line 56, “FIG. 13 is a” should read --FIGS. 13(a) and 13(b) are--; and “view” should read --views--;
Line 60, “FIG. 14 is a” should read --FIGS. 14(a) - 14(c) are--; and “view” should read --views--; and
Line 64, “FIG. 15 is a” should read --FIGS. 15(a) - 15(c) are--; and “view” should read --views--.

COLUMN 5:

Line 1, “FIG. 16 is a” should read --FIGS. 16(a) and 16(b) are--; and “view” should read --views--;
Line 7, “FIG. 18 is a” should read --FIGS. 18(a) and 18(b) are--; and “view” should read --views--; and
Line 34, “its,” should read --is,--.

UNITED STATES PATENT AND TRADEMARK OFFICE

CERTIFICATE OF CORRECTION

PATENT NO. : 6,993,273 B2
APPLICATION NO. : 10/761316
DATED : January 31, 2006
INVENTOR(S) : Yusuke Yamada It is certified that error appears in the above-identified patent and that said Letters Patent is hereby corrected as shown below:

COLUMN 8:

Line 31, "(FIG. 8" should read --(FIG. 4(b)--; and
Line 32, "FIG. 9(e)" should read --FIG. 9(a)--.

COLUMN 9:

Line 57, "is" should be deleted.

COLUMN 10:

Line 54, "baffling" should read --baffle--; and
Line 62, "then" should read --the--.

COLUMN 11:

Line 27, "FIG. 8" should read --FIGS. 8(a) - 8(d),--; and
Line 51, "FIGS. 9-11," should read --FIGS. 9(a) and 9(b), FIGS. 10(a) -10(e) and FIG. 11,--.

COLUMN 12:

Line 56, "radius" should read --radial--.

COLUMN 13:

Line 4, "ribs" should read --ribs 20a--.

COLUMN 16:

Line 47, "form" should read --from--.

COLUMN 17:

Line 23, "FIG. 15," should read --FIGS. 15(a) - 15(c),--; and
Line 27, "bee" should read --been--.

COLUMN 18:

Line 10, "Therefore" should read --Therefore,--.

UNITED STATES PATENT AND TRADEMARK OFFICE

CERTIFICATE OF CORRECTION

PATENT NO. : 6,993,273 B2
APPLICATION NO. : 10/761316
DATED : January 31, 2006
INVENTOR(S) : Yusuke Yamada It is certified that error appears in the above-identified patent and that said Letters Patent is hereby corrected as shown below:

COLUMN 20:

Line 13, "the" (third occurrence) should be deleted.

COLUMN 21:

Line 25, "FIG. 14," should read --FIGS. 14(a) - 14(c),--.

COLUMN 22:

Line 34, "FIG. 15," should read --FIGS. 15(a) - 15(c),--.

COLUMN 23:

Line 15, "FIG." should read --FIGS. 16(a) and 16(b).--;
Line 17, "16." should be deleted; and
Line 24, "FIG. 16," should read --FIGS. 16(a) and 16(b),--.

COLUMN 24:

Line 43, "FIGS. 16 and 17" should read --FIGS. 16(a) and 16(b) and FIG. 17--.

COLUMN 25:

Line 42, "FIGS. 16 AND 17" should read --FIGS. 16(a) and 16(b) and FIG. 17--.

Signed and Sealed this

Fifth Day of September, 2006

JON W. DUDAS
*Director of the United States Patent and Trademark Office*